US006461197B2

(12) United States Patent
Crane, Jr. et al.

(10) Patent No.: US 6,461,197 B2
(45) Date of Patent: Oct. 8, 2002

(54) FEMALE CONTACT PIN INCLUDING FLEXIBLE CONTACT PORTION

(75) Inventors: Stanford W. Crane, Jr.; Lakshminarasimha Krishnapura; Arindum Dutta; Kevin Link, all of Boca Raton, FL (US)

(73) Assignee: Silicon Bandwidth, Inc., Fremont, CA (US)

( * ) Notice: Subject to any disclaimer, the term of this patent is extended or adjusted under 35 U.S.C. 154(b) by 0 days.

(21) Appl. No.: 09/860,606

(22) Filed: May 21, 2001

(65) Prior Publication Data

US 2001/0034164 A1 Oct. 25, 2001

Related U.S. Application Data

(62) Division of application No. 08/911,010, filed on Aug. 14, 1997, now Pat. No. 6,247,972.

(51) Int. Cl.[7] ..... H01R 24/00; H01R 33/00

(52) U.S. Cl. ..... 439/660

(58) Field of Search ..... 439/660, 931, 439/284, 295, 862, 79, 268

(56) References Cited

U.S. PATENT DOCUMENTS

| | | | |
|---|---|---|---|
| 3,337,838 A | 8/1967 | Damiano et al. | 439/295 |
| 3,585,573 A | 6/1971 | Robshaw | 439/887 |

(List continued on next page.)

FOREIGN PATENT DOCUMENTS

| | | |
|---|---|---|
| EP | 0 405 454 A2 | 1/1991 |
| FR | 2286523 | 4/1976 |
| FR | 2681985 | 4/1993 |
| JP | 2-142077 | * 5/1990 |
| WO | WO 94/27345 | 11/1994 |
| WO | WO 96/41400 | 12/1996 |

OTHER PUBLICATIONS

AMP Product Guide, Printed Circuit Board Connectors, Amp Incorp., 1991 (pp. 3008,3067, 3068, 3102–3103, 3122, and 3123).

Optimisation. Toute L'electronique, 1985.

*Primary Examiner*—Khiem Nguyen
*Assistant Examiner*—Javaid Nasri
(74) *Attorney, Agent, or Firm*—Morgan, Lewis & Bockius LLP

(57) ABSTRACT

An electrical connector includes a male connector and a female connector. The female connector includes a female connector housing and a plurality of female contact pins. The female contact pins includes a contact portion, a stabilizer portion, and a tail portion. The contact portion extends from the stabilizer portion at an angle. A lateral distance spanned by the angled contact portion is substantially the same as or less than the width of the stabilizer portion in the same direction. The female contact pins are arranged on the female connector housing in clusters of four. The clusters are arranged in rows such that each pair of rows defines five rows of female contact pins. The male connector includes a male connector housing and a plurality of male contact pins. The male connector housing has a plurality of buttresses extending therefrom. The male contact pins are arranged on the male connector housing to correspond to the arrangement of female contact pins. Each of the male contact pins has a slight angle to prevent separation between the male contact pin and its corresponding buttress.

5 Claims, 54 Drawing Sheets

U.S. PATENT DOCUMENTS

| | | | | | |
|---|---|---|---|---|---|
| 3,827,007 | A | | 7/1974 | Fairbairn et al. | 439/293 |
| 4,274,700 | A | | 6/1981 | Keglewitsch et al. | 439/682 |
| 4,655,528 | A | * | 4/1987 | Groft | 439/404 |
| 4,660,272 | A | | 4/1987 | Barnhouse et al. | 29/558 |
| 4,728,304 | A | | 3/1988 | Fischer | 439/842 |
| 4,734,060 | A | | 3/1988 | Kawawada et al. | 439/660 |
| 4,778,231 | A | | 10/1988 | Siedler et al. | 439/857 |
| 4,838,800 | A | | 6/1989 | Lynch | 439/78 |
| 4,867,690 | A | * | 9/1989 | Thumma | 439/79 |
| 4,897,055 | A | | 1/1990 | Jurista et al. | 439/924 |
| 4,975,066 | A | | 12/1990 | Sucheski et al. | 439/63 |
| 4,997,376 | A | | 3/1991 | Buck et al. | 439/59 |
| 5,071,363 | A | | 12/1991 | Reylek et al. | 439/291 |
| 5,224,866 | A | | 7/1993 | Nakamura et al. | 439/81 |
| 5,330,372 | A | | 7/1994 | Pope et al. | 439/692 |
| 5,362,256 | A | | 11/1994 | Hashiguchi | 439/660 |
| 5,575,688 | A | | 11/1996 | Crane Jr. | 439/660 |
| 5,634,821 | A | | 6/1997 | Crane Jr. | 439/660 |
| 5,641,309 | A | | 6/1997 | Crane Jr. | 439/660 |
| 5,906,518 | A | | 5/1999 | Sun | 439/660 |

* cited by examiner

FEMALE CONTACT PIN INCLUDING FLEXIBLE CONTACT PORTION

This is a divisional application of application No. 08/911,010 filed on Aug. 14, 1997, issued as U.S. Pat. No. 6,247,972, the disclosure of which is hereby incorporated by reference herein in its entirety. This application is related in subject matter to U.S. Pat. No. 6,050,850, entitled "Electrical Connector Having Staggered Hold-Down Tabs", filed Aug. 14, 1997, and expressly incorporated by reference herein.

BACKGROUND OF THE INVENTION

1. Field of the Invention

The present invention relates to an electrical connector, and more particularly to an electrical connector that is easily manufactured, mounts stably to a substrate, and provides a high contact density in a given area on the substrate.

2. Description of the Prior Art

Conventional electrical connector assemblies include complementary male and female connectors for establishing electrical connections between electrical systems and components. For example, computers and other electrical equipment include electrical connectors for connecting printed circuit boards, for connecting a printed circuit board to a backplane, and/or for connecting a printed circuit board to a cable. One exemplary connector is shown in U.S. Pat. No. 5,575,688 to Stanford W. Crane, Jr.

The female contacts of conventional electrical connectors, particularly those used in edge connectors, have a complex, arcuate shape. One example of such a female contact is illustrated in FIG. 1. The contact portion contacts the male contact to establish an electrical connection. The contact portion is angled or bowed to allow the female contact to flex when mated with the male contact. The normal force of the flexed female contact against the male contact produces an electrical connection. A stabilizing portion retains the female contact in a female connector housing.

Conventional electrical connectors are difficult and expensive to manufacture. One reason is that the female contacts are difficult to insert into a female connector housing. In a female edge-type connector, the tail portion of a female contact is formed in a right angle. Consequently, the female contact must be inserted through a hole in the female connector housing with the contact portion inserted first. Because the contact portion has a bow or angle that extends well beyond the periphery of the stabilizing portion, a complex maneuver is required to thread the contact portion through the hole in the female connector housing.

Another reason that conventional electrical connectors are difficult and expensive to manufacture is that the contacts are not arranged in the housings in a manner conducive to efficient manufacture. Finally, some conventional electrical connectors include a male connector housing having an array of buttresses. Male contacts are disposed around each male buttress. One problem with this arrangement is "banana peeling," where the male contacts bend or peel away from the buttress. A consequence of banana peeling is that the male contacts may contact the wrong female contact or another male contact.

Moreover, the male and female contacts are manufactured by stamping metal from metal stock. The contacts lose a measure of flexibility and resiliency when stamped. The loss of flexibility and resiliency particularly impairs the functionality of the female contacts, which typically flex to establish an electrical connection with male contacts. For example, the female contacts may become misaligned and/or the normal force between the connected male and female contacts may be reduced.

Accordingly, there is a need in the art to provide an electrical connector that is not subject to the deficiencies of conventional electrical connectors.

SUMMARY OF THE INVENTION

The present invention has been made in view of the above circumstances and has as an object to provide an electrical connector that is easily manufactured and provides reliable electrical contacts.

A further object is to provide a high density electrical connector that is easily manufactured and provides a high density of reliable electrical contacts.

A further object of the invention is to provide an electrical connector that having contact pins arranged in a pattern that facilitates manufacture.

A further object of the present invention is to provide an electrical connector that is not subject to banana peeling.

A further object of the invention is to provide a female connector that is easily manufactured and provides reliable electrical contacts.

A further object of the invention is to provide a female contact pin that facilitates manufacture of an electrical connector and provides a reliable electrical contact.

A further object of the invention is to provide a contact pin that is easily manufactured and that provides a reliable electrical contact.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an electrical connector assembly having a male connector, including a male connector housing and a plurality of male contact pins secured in the male connector housing, and a female connector, including a female connector housing and a plurality of female contact pins secured within holes formed in the female connector housing. Each of the female contact pins include a stabilizer portion adapted to secure the female contact pin to the female connector housing and a flexible contact portion extending from the stabilizer portion. When the contact portion is not flexed, a distance spanned by the contact portion in each direction orthogonal to a longitudinal axis of the stabilizer portion is substantially the same as or less than a distance spanned by the stabilizer portion in a corresponding direction.

The invention further comprises an electrical connector having an insulative housing having a plurality of holes formed therethrough and a plurality of contact pins secured within the holes of the insulative housing. Each of the contact pins include a resilient beam portion and a stabilizer portion secured in the insulative housing for retaining the contact pin. The stabilizer portion has an outer periphery. The resilient beam portion, when at rest, is substantially enclosed within a projection of the outer periphery of the stabilizer portion.

The invention further comprises a female contact pin for use in an electrical connector. The female contact pin has a stabilizer portion configured for securement to a female connector housing and a flexible contact portion for contacting a male contact. The stabilizer portion has a longitudinal axis and a first width transverse to the longitudinal axis. When the flexible contact portion is unflexed, the flexible contact portion extends at an angle from the stabilizer portion to traverse a lateral distance in a direction of the first width, wherein the lateral distance spanned by the entirety of the flexible contact portion in a direction of the first width is substantially the same as or less than the first width.

The invention further comprises an electrical contact pin comprising a mounting portion configured to establish an electrical contact with a substrate, a free portion configured to contact a section of a complementary electrical contact pin, the free portion being movable between at rest and flexed positions, and a stabilizing portion disposed between the mounting and free portions and configured for securement to an insulative housing. The stabilizing portion has an outer periphery defining a projected volume within which the free portion is substantially confined in the at rest position.

The invention further comprises a method of manufacturing an electrical contact pin, which includes the steps of cutting a tail portion from wire stock such that a periphery of the tail portion is displaced from a periphery of the wire stock in directions perpendicular to a longitudinal axis of the wire stock, and forming a contact portion opposite the tail portion.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiment(s) of the invention and together with the description, serve to explain the principles of the invention.

DESCRIPTION OF THE PREFERRED EMBODIMENT

Reference will now be made in detail to the present exemplary embodiment(s) of the invention illustrated in the accompanying drawings. Wherever possible, the same reference numbers will be used throughout the drawings to refer to the same or like parts.

Figure 1:
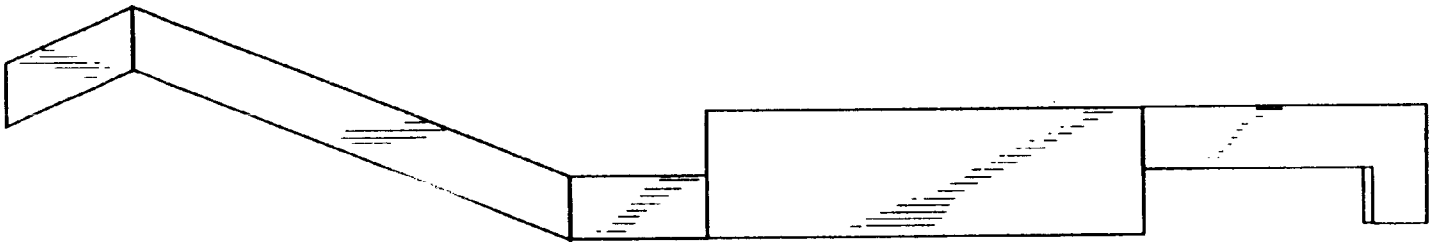
FIG. 1 PRIOR ART
FIG. 1 illustrates a conventional female contact for use in an electrical connector.
Figure 2:
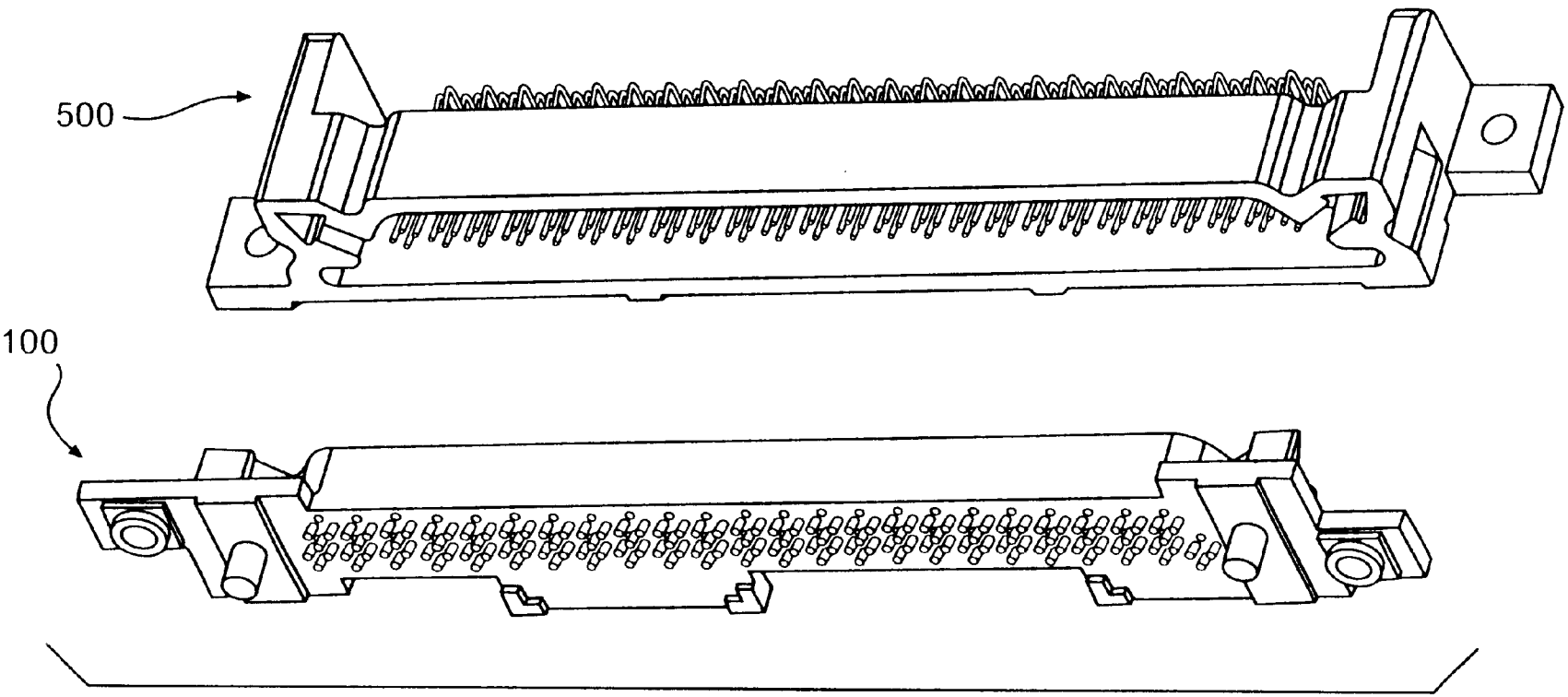
FIGS. 2 and 3 show a male connector and a female connector in accordance with the present invention.
Figure 3:
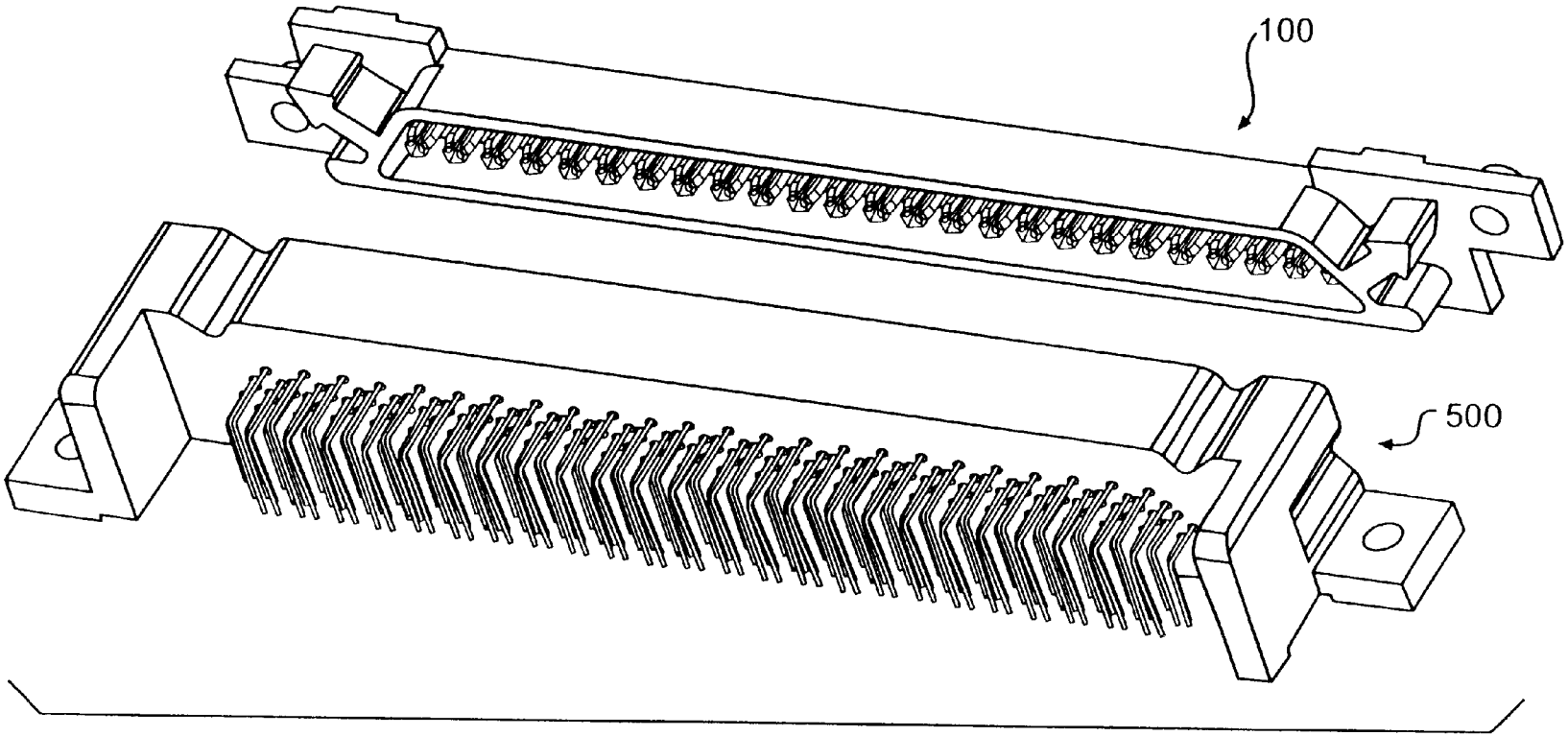

FIGS. 2 and 3 illustrate two views of a male connector 100 and a female connector 500. The male connector 100 may be secured to a substrate, such as a printed circuit board or a backplane mounting, or a cable, a ribbon cable, a flat flexible cable, or a discrete wire, among other things. Similarly, female connector 500 may be secured to a substrate (not shown). The female connector 500 receives the male connector 100 to establish an electrical connection. Connectors 100, 500 are particularly useful in data communications applications, telephone communications applications, automotive and aircraft applications, and other applications where a high density of electrical contacts is desirable, for example, in an area of a substrate or along the edge of a substrate.

The male connector 100 will be discussed in greater detail in connection with FIGS. 4–9. The male connector 100 includes a male connector housing 110 and a plurality of male contact pins 105 secured in the male connector housing 110. The male connector housing 110 is formed of an insulative material, for example, a polymer or other suitable electrically insulative material. For example, a liquid crystal polymer, such as Hoechst Celanese's VECTRA™, may be used as the material for the male electrical connector housing 110. Of course, the male connector housing 110 may include metallic shielding against noise or other interference. For example, side wall 120 of the male connector housing may include a metallic insert, such as a metallic strip or series of strips, which may be molded into the side wall material. Alternatively, a separate shielding sleeve or shroud (not shown) may fit over the male and/or female connectors, or over the mated male and female connectors. The shielding sleeve or shroud may be formed entirely of metal or may include insulation.

Figure 4A:
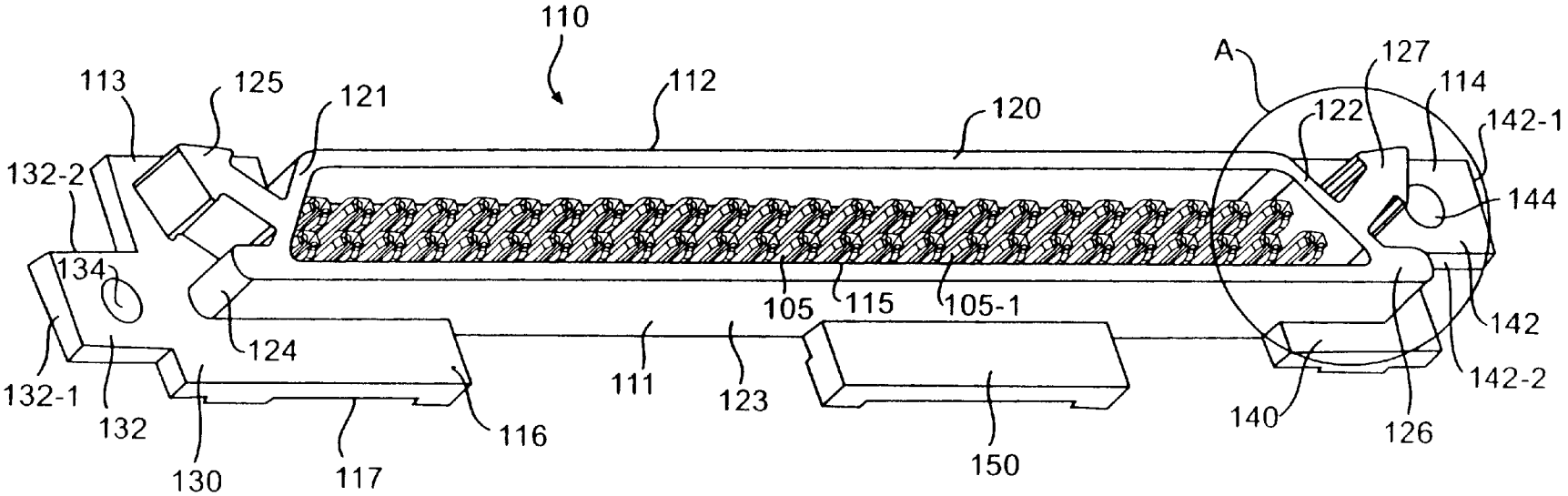
FIG. 4A illustrates a view of the top of a vertical male connector 100.
Figure 4B:
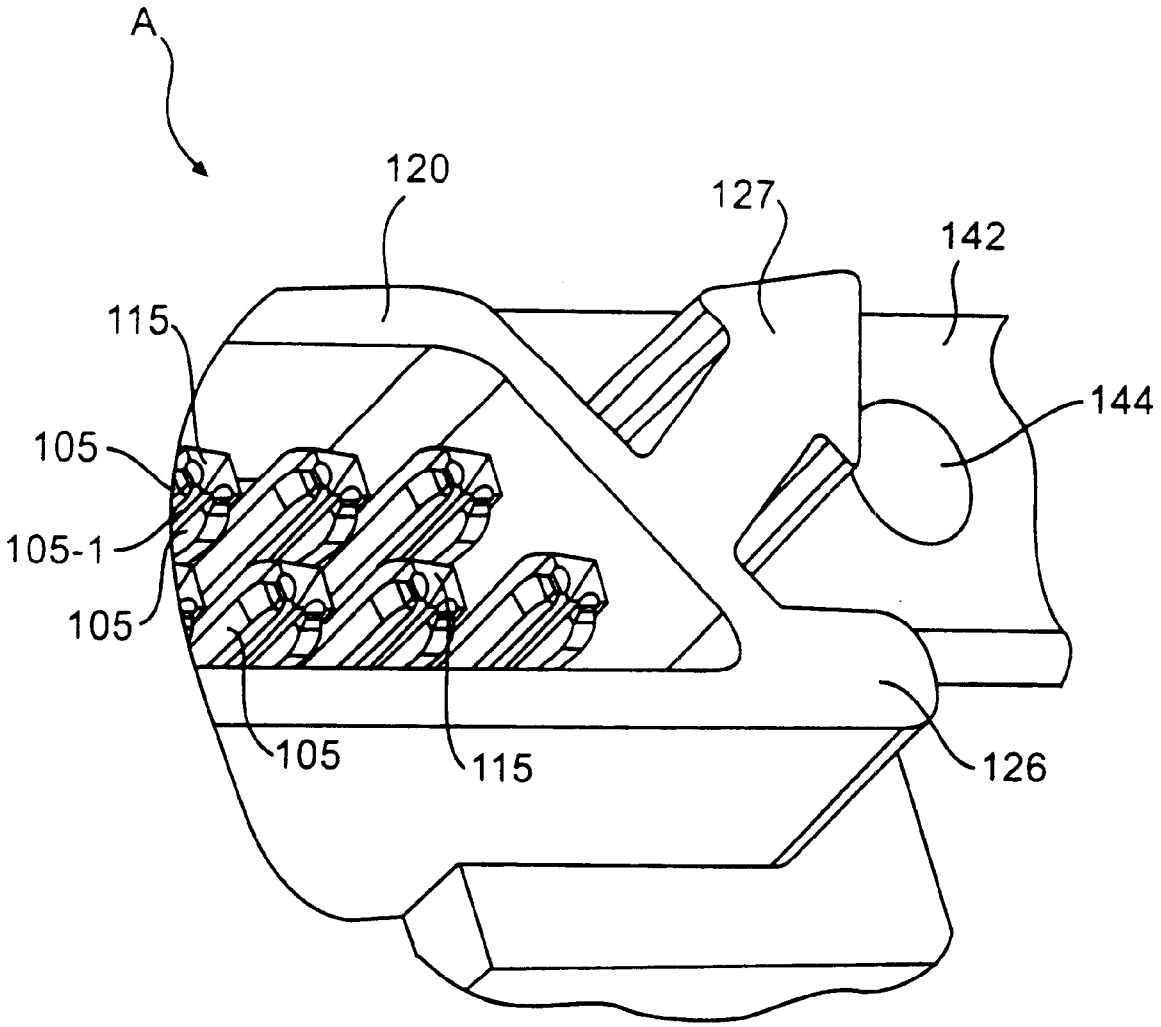
FIG. 4B illustrates a portion of vertical the male connector 100 shown in FIG. 4A.

FIG. 4A illustrates the front of the male connector 100. As shown, male connector housing 110 includes a first side 11, a second side 112, a first end 113, a second end 114, a top face 116, and a bottom face 117. An array of buttresses 115 extends from the top face 116. The buttresses 115, for example, have a generally rectangular cross section. Clusters of four male pins 105-1 are arranged on respective sides of the buttresses 115, as illustrated in, for example, FIG. 4B. Both the male pins 105 and the clusters of male pins 105-1 are arranged in rows. Of course, other arrangements are possible consistent with the present invention. For example, buttresses 115 may have a different shape or may be omitted entirely, and the male pins 105 may be arranged in clusters of one or more.

By way of example, the buttresses 115 may be provided with different heights in order to reduce insertion force. In addition, the buttresses 115 may be staggered and/or nested such that the contact surface of the male pin in one cluster faces the side surface of a male pin in another cluster. In this regard, reference may be made to U.S. Pat. No. 5,641,309 to Stanford W. Crane, Jr.

A side wall 120 may be provided on the top face 116 of the male connector housing 110 to continuously surround buttresses 115. An interior surface of side wall 120 may be formed with a slight angle, one degree, for example, to facilitate removal from a mold during manufacture. The height of the side wall 120 is preferably greater than the heights of buttresses 115 and male pins 105. The side wall 120 serves, among other things, to protect the male pins 105 and the buttresses 115 before, during, and after mating, and in the event of mismatch. Of course, it is not necessary for the side wall 120 to continuously surround the buttresses 115 in order to protect the male pins 105 and buttresses 115. The side wall 120 may partially enclose or bracket the male pins 105.

The side wall 120 may include polarization features to prevent a mismatch between the male connector 100 and female connector 500. For example, a rounded projection 124 and an arrow-shaped projection 125 may project from a top face 116 of the male connector housing. As shown in FIG. 4A, for example, both the rounded projection 124 and the arrow-shaped projection 125 may extend from or be merged with an end 121 of side wall 120. The top face 116 of male connector housing may also include a rounded projection 126 and an arrow-shaped projection 127. The rounded projection 126 and the arrow-shaped projection 127 may extend from or be merged with an end 122 of side wall 120. As shown in FIG. 4A and elsewhere, arrow-shaped projection 125 generally points diagonally toward side 112 and end 113 of the male connector housing 110 and arrow-shaped projection 127 generally points diagonally toward side 112 and end 114 of the male connector housing 110. Of course, the arrow-shaped projections 125, 127 may point in other directions, for example, toward side 111, instead of side 112, or one arrow-shaped projection may point generally toward side 112 and the other may point generally toward side 111. Other asymmetrical arrangements may be formed to ensure that mating between the male connector 100 and the female connector 500 may occur in only one orientation.

Rounded projections 124, 126 and arrow-shaped projections 125, 127, in particular, are visually distinctive and may be quickly and, readily identified by a user to enable the user to properly orient the male connector 100 with respect to the female connector 500 for mating. Of course, the projections may have another easily-identifiable geometric shape, such as a circle, diamond cross, star, square, number, among others, or may have a combination of geometric shapes, sizes, and orientations. Rounded projections 124, 126 and arrow-shaped projections 125, 127 also prevent mating at an improper angle, at an offset, or both, and, in combination with side wall 120, prevent the female connector 500 from damaging the male pins 105 in the event of mismatch. Alternatively, only one of any of the polarization features described above may be provided.

The male connector housing 110 further includes a plate 130 at the first end 113 of male connector housing 110, a plate 140 at the second end 114 of the male connector housing 110, and a stop plate 150 disposed at an exterior side surface 123 of side wall 120. Plates 130, 140 include hold-down tabs or extensions 132, 142. A hold-down tab may be a flange, seat, bracket, plate, annulus, or other mounting feature or surface for securing a connector housing to a substrate. Hold-down tabs 132, 142 serve to mount the male connector housing 110 to a substrate. For example, apertures 134, 144 may receive screws, rivets, or other fasteners to secure the male connector housing 110 to a printed circuit board or other substrate. Of course, consistent with the present invention, the apertures 134, 144 may be replaced by snap connectors or other fastening devices for connecting or facilitating connection of the male connector housing 110 to a printed circuit board or other substrate.

Hold-down tabs 132, 142 are diagonally disposed, staggered, or offset with respect to the male connector housing 110. In this regard, hold-down tab 132 is disposed proximal the first side 111 and distal the second side 112, and hold-down tab 142 is disposed proximal the second side 112 and distal the first side 111. The diagonally disposed hold-down tabs 132, 142 enable the male connector housing 110 to be stably secured to the printed circuit board or other substrate without rocking or other movement. Further, hold-down tabs 132, 142 may be complementary to permit nesting or merging with other male connectors 100 such that the male pins 105 of the connectors are aligned when their connector housings are fit together. For additional details concerning the hold-down tabs 132, 142, reference may be made to U.S. application No. [Attorney Docket No. 40879-5075], filed concurrently herewith and expressly incorporated by reference.

Figure 5:
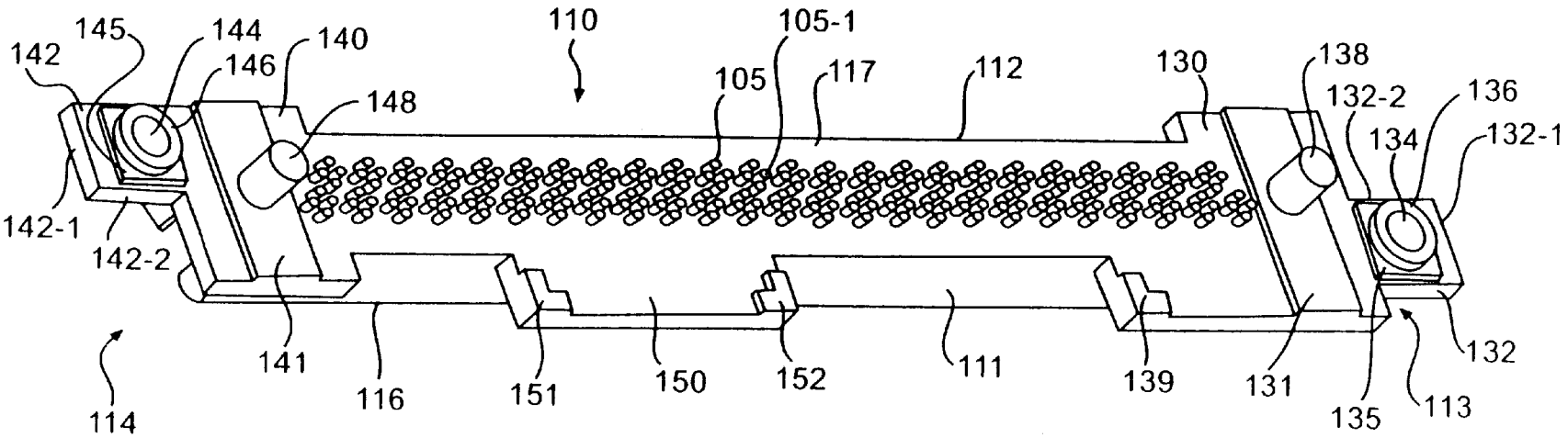
FIG. 5 illustrates the bottom of the vertical male connector 100.
Figure 6A:
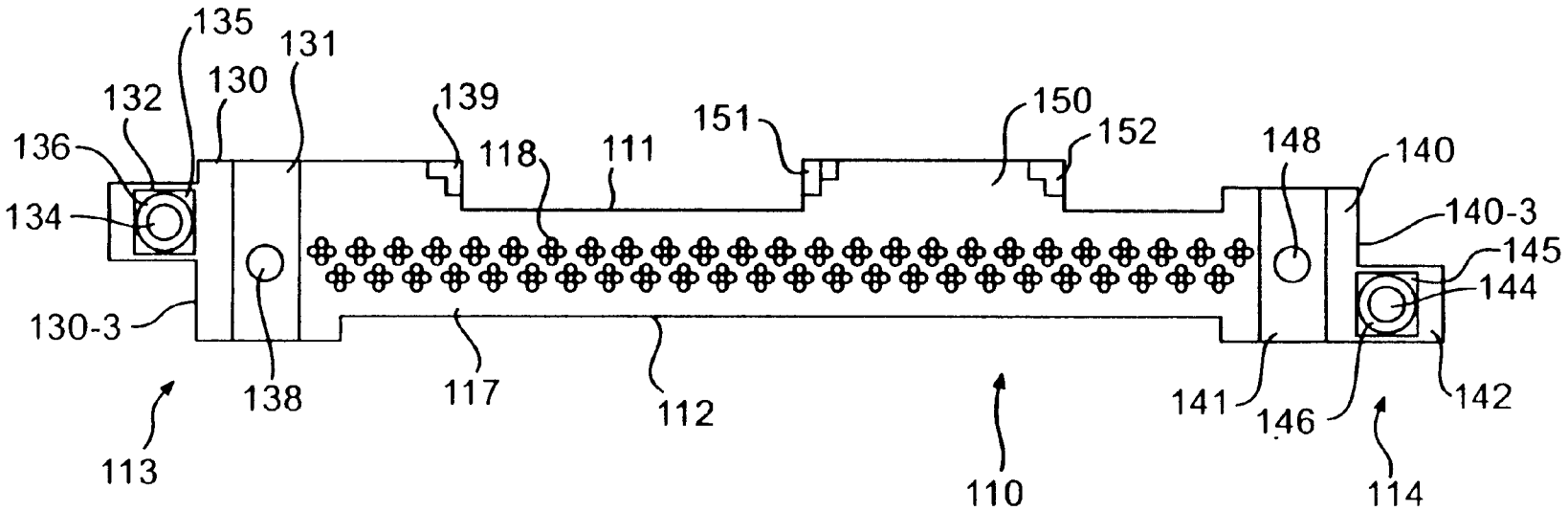
FIG. 6A shows the bottom of the vertical male connector housing 110.

FIG. 5 illustrates the bottom face 117 of male connector 100 and the tail of the male pins when the male pins 105 are inserted into the male connector 100. FIG. 6A illustrates the bottom face 117 of the male connector 100 with male pins 105 removed. The tail ends of male pins 105 extend from a generally flat surface of bottom face 117. Elevated stand-offs 131, 135, 139, 141, 145, 151, and 152 provide a mounting surface for the male connector housing 110 for mounting to the surface of the printed circuit board or other substrate. The stand-offs balance the male connector housing 110 on the substrate, yet permit air flow between the bottom face 117 of the connector housing 110 and the printed circuit board or other substrate.

Stand-offs 135, 145 extend from hold-down tabs 132, 142, respectively. Stand-offs 135, 145 may include guide sleeves 136, 146 at aperture 134, 144 for seating within apertures formed in the substrate to accurately position the male connector housing 110. Similarly, posts 138, 148 may extend from stand-offs 131, 141, respectively, for further positioning the male connector 110 and guiding it into the substrate.

Figure 6B:
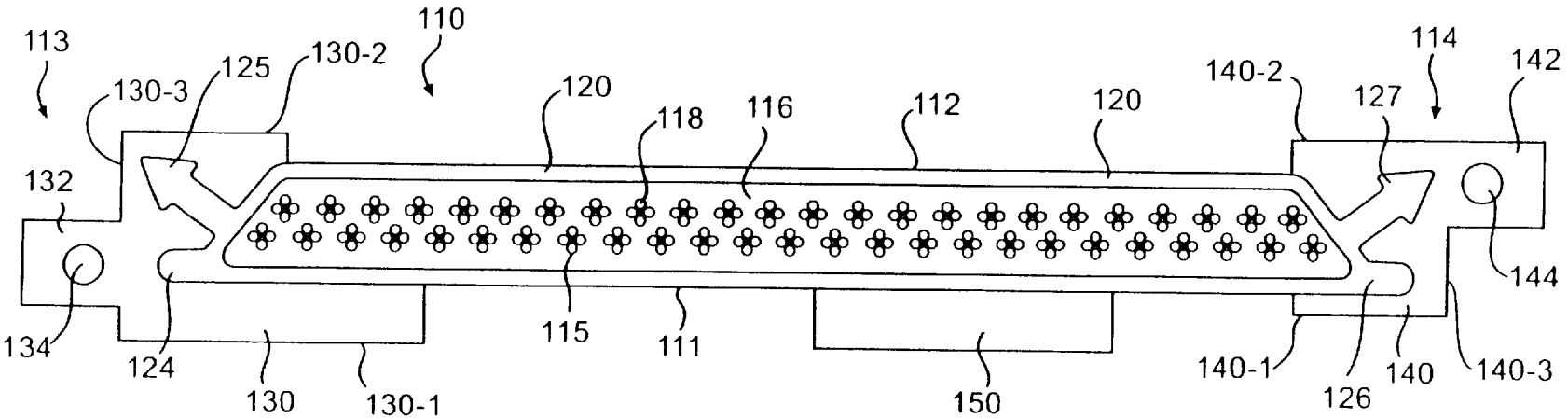
FIG. 6B shows the top of the vertical male connector housing 110.

FIG. 6B illustrates the top face 116 of the male connector housing 110 prior to insertion of the male pins 105. Plates 130, 140 includes side edge portions 130-1, 140-1 and side edge portions 130-2, 140-2. Side edge portions 130-2 and 140-2 may extend an equal distance in a lateral direction away from side wall 120, but this is not necessary. Side edge portion 130-1 extends along side wall 120 for a distance, but terminates before reaching stop plate 150, leaving a first gap. The first gap is at least as wide as stop plate 150, for reasons discussed further below. Side edge portion 130-1 and stop member 150 may extend laterally away from side wall 120 for a distance sufficient to ensure that a printed circuit board will abut the side edge portion 130-1 and stop member 150 when the male connector is mated with a female connector. Side edge portion 130-1 and stop member 150 may or may not extend an equal distance from side wall 120. Side edge portion 140-1 may extend laterally away from side wall 120 a distance substantially less than that of side edge portion 130-1 and stop plate 150, as shown in the drawings. However, this is not required for purposes of the present invention.

Stop plate 150 and side edge portion 130-1 together provide a positive stop for the female connector 500 during mating and provide support the female connector 500 after mating. Therefore, the load of female connector 500 on the male connector 100, both during and after mating, is not supported by the male or female pins. Rather, the load from the female connector and the printed circuit board or other substrate is supported by the male connector housing 110, specifically the stop plate 150 and the side edge portion 130-1. Further, the positive stop prevents the male and female pins and/or the buttresses from bottoming out against another structure. In addition, the stop plate 150 and side edge portion 130-1 support the printed circuit board or other substrate to which the female connector 500 is attached to prevent rocking and to maintain stability.

Of course, an edge portion 130-1 and stop plate 150 are not both required. For example, a single stop plate 150 may be sized to prevent rocking and to support the printed circuit board and female connector by itself, or multiple stop plates 150 may be provided. Alternatively, side edge portion 130-1 alone may be adapted for stabilizing and supporting the female connector. Further, it is preferable, but not necessary, that side 111 of the male connector housing 110 includes projections (e.g., edge portion 130-1 and/or stop plate 150) and indents (e.g., the gap between edge portion 130-1 and stop plate 150) to permit the sides 111 of two male connector housings to fit together. As discussed below, it is not necessary for the projections to fit snugly in the indents when the sides of two male housings are fit together. The projections may fit loosely in the indents consistent with the present invention.

Figure 7A:
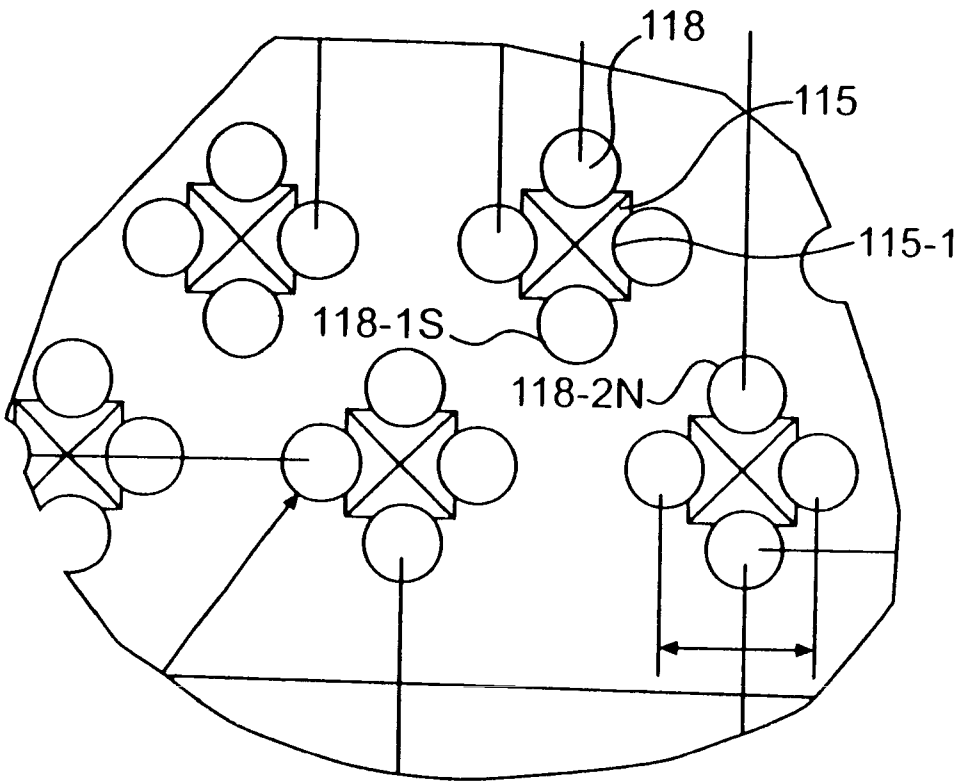
FIG. 7A shows a detail of the bottom of the vertical male connector housing 110.

FIGS. 6A, 6B, 7A, and 7B illustrate the holes 118 formed through the male connector housing 110 for holding the male pins 105. The holes 118 are circular and arranged in clusters, for example, clusters of four, although other numbers may be used. Of course, the holes 118 may be another shape, for example rectangular or square, so long as male pins 105 are securely held within the male connector housing 110. FIG. 7A shows that buttresses 115 include axial notches 115-1 along their lengths for receiving male pins 105. The holes 118 are arranged in a zig-zag pattern such that the South hole 118-1S of a first cluster is located adjacent to the North hole 118-2N of another cluster.

Figure 7B:
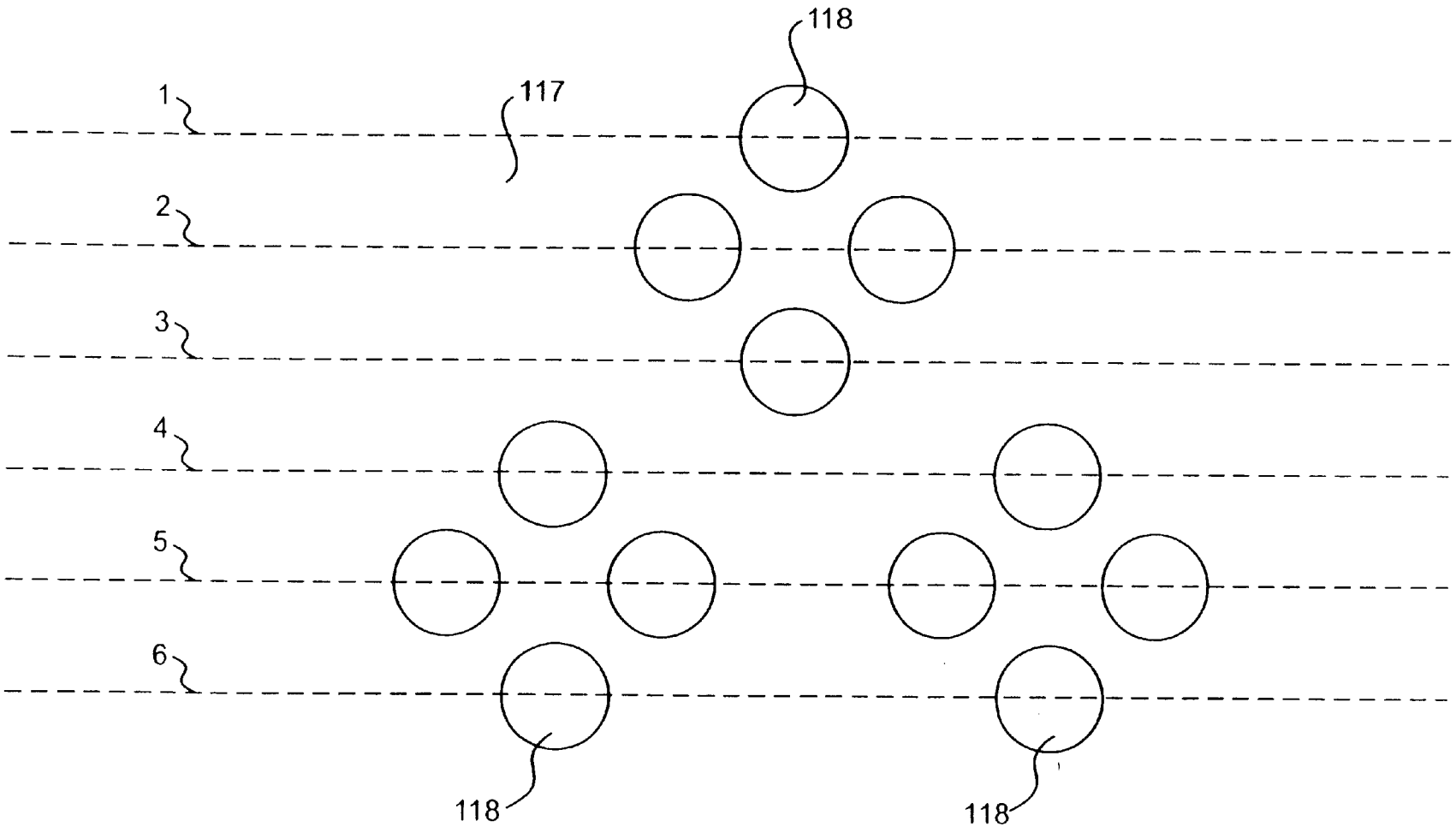
FIG. 7B shows a detail of the top of the vertical male connector housing 110.

FIG. 7B illustrates the arrangement of holes 118 through the male connector housing 110. As shown, clusters of holes 118 may be arranged in rows such that each pair of rows includes six rows of holes 118. In this regard, the South hole 118-1S of a first cluster is spaced from the North hole 118-2N of the other cluster. Of course, other arrangements are possible. For example, the holes 118 may be arranged such that the South hole 118-1S of a first cluster is aligned with the North hole 118-2N of the other cluster. Consequently, clusters of holes 118 would define only five lines or rows of holes across the length of the male connector housing 110. Manufacture may be simplified because an automated pin insertion machine needs to make only five passes across the male connector housing 110 to insert male pins 105 in the five lines of holes 118. In addition, for edge-type male connectors, the distance between the five rows of holes 118 and the substrate is reduced compared to an arrangement with six rows of holes. Thus, the vertical length of the tail portion may be reduced.

As discussed in greater detail below, a bandolier may be used to feed male pins 105 for automated insertion into holes 118. Male pins 105 may be oriented on the bandolier in different directions for simplified insertion into the appropriate hole. For example, the male pins may be oriented in order of N, S, N, S, . . . and/or in order of W, E, W, E, . . . for insertion along interior lines 2, 3, and 4. Accordingly, the automated insertion machinery is not required to orient the male pins prior to insertion. Alternatively, the male pin insertion machine may traverse along a diagonal with male pins loaded in the bandolier, for example, in order of W, N, E, S, N, W, S, E, . . . Also, multiple pins may be inserted simultaneously, for example, one cluster at a time or a portion of a cluster (e.g., two contact pins) at a time. The connector housing may be rotated or otherwise oriented to facilitate insertion of the contact pins. Of course, the automated insertion machinery may orient the contact pins prior to insertion.

Figure 7C:
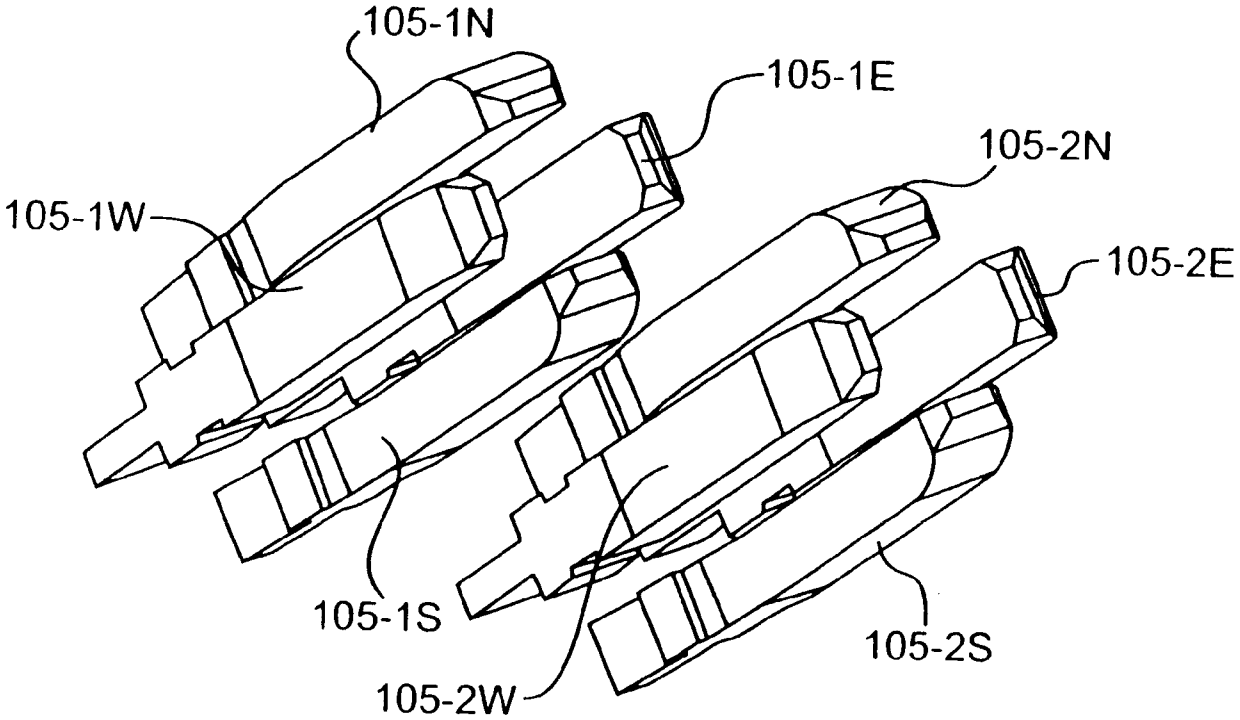
FIG. 7C illustrates two clusters of male contact pins 105 as they would be arranged in holes 118 of male connector housing.

FIG. 7C shows two clusters of male pins 105 as they would be arranged in holes 118. A first cluster includes male pins 105-1N, 105-1S, 105-1W, and 105-1E and a second cluster includes male pins 105-2N, 105-2S, 105-2W, and 105-2E. In connection with male pins, an "N" is used to designate a male pin 105 having a contact surface facing up, an "S" is used to designate a male pin 105 having a contact surface facing down, a "W" is used to designate a male pin 105 having a contact surface facing to the left, and an "E" is used to designate a male pin 105 having a contact surface facing to the right.

Figure 7D:
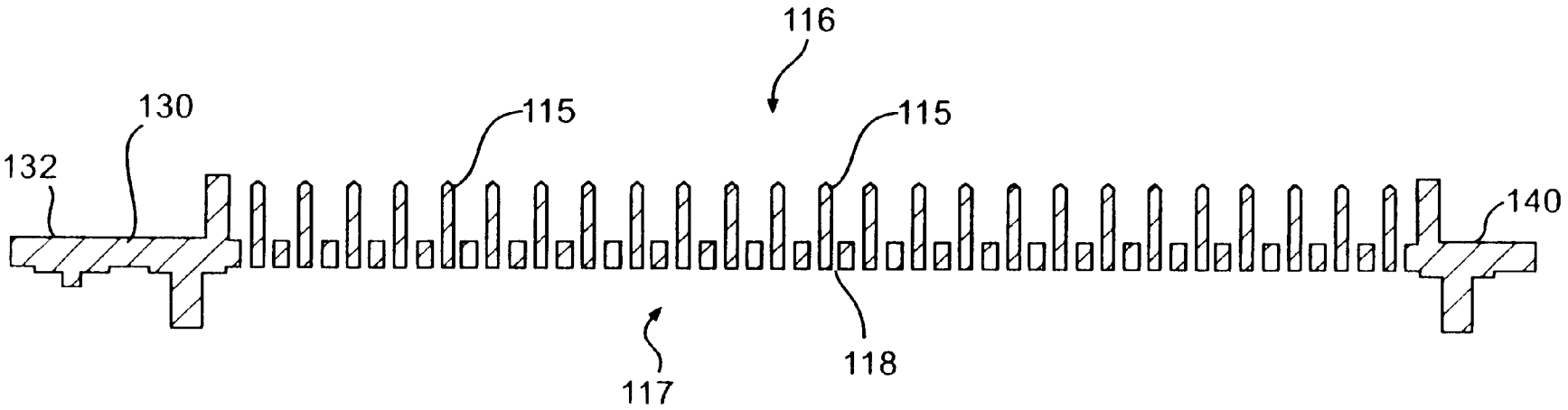
FIG. 7D shows a cross section of male connector housing 110.

FIG. 7D illustrates a cross section of the male connector housing 110. As shown, the holes 118 pass entirely through the male connector housing. FIG. 7D also shows that the height of the side wall 120 may be greater than the height of the buttresses 115.

Figure 8A:
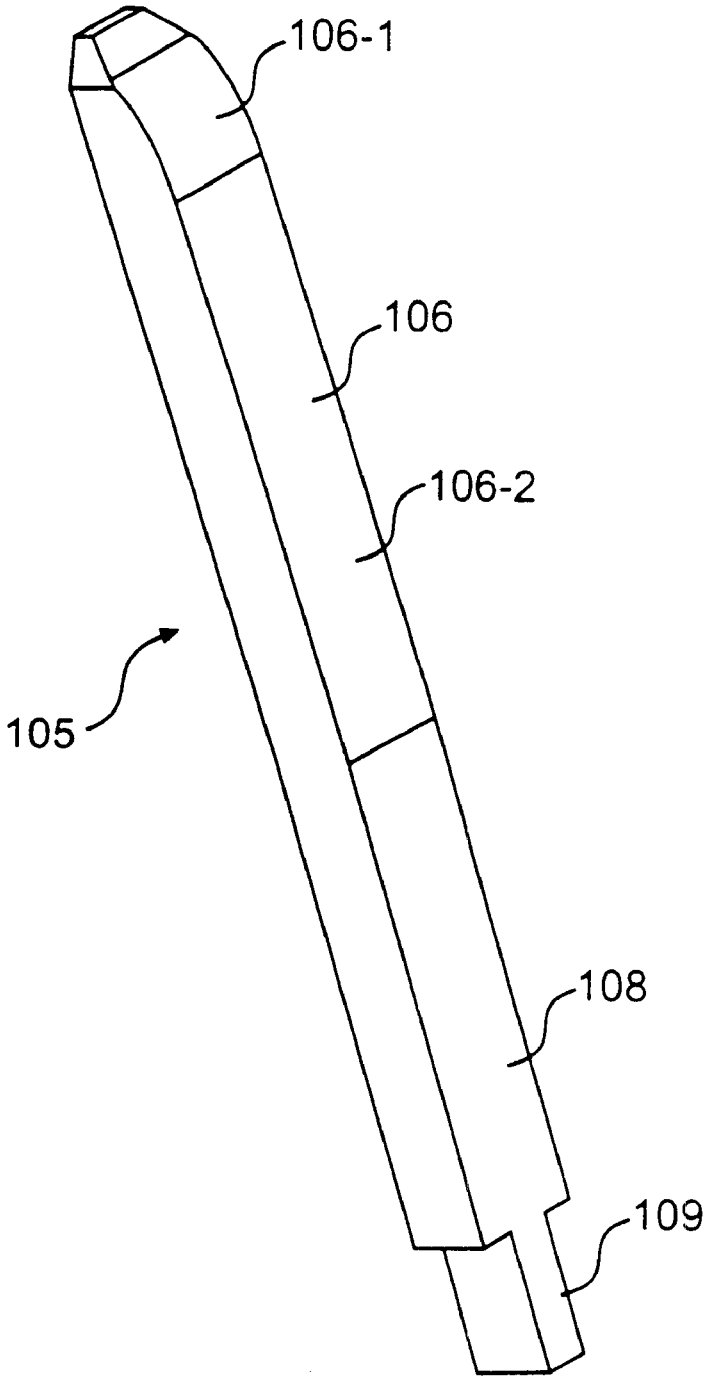
FIGS. 8A, 8B, and 8C illustrate a first embodiment of male contact pins 105.
Figure 8B:
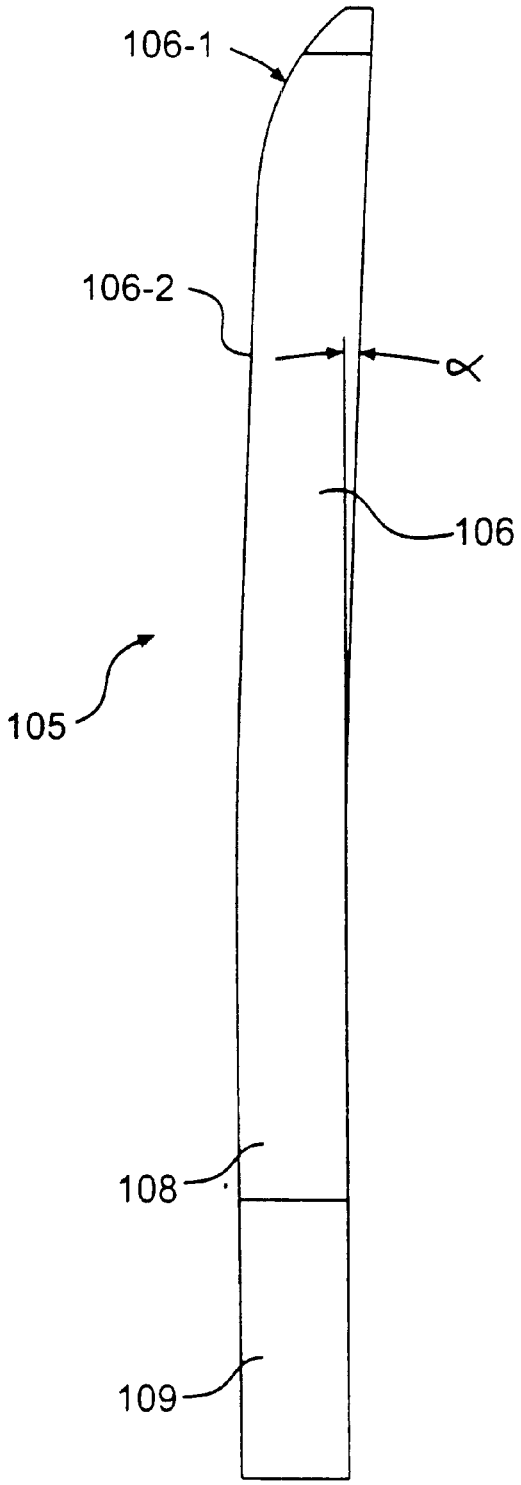
Figure 8C:
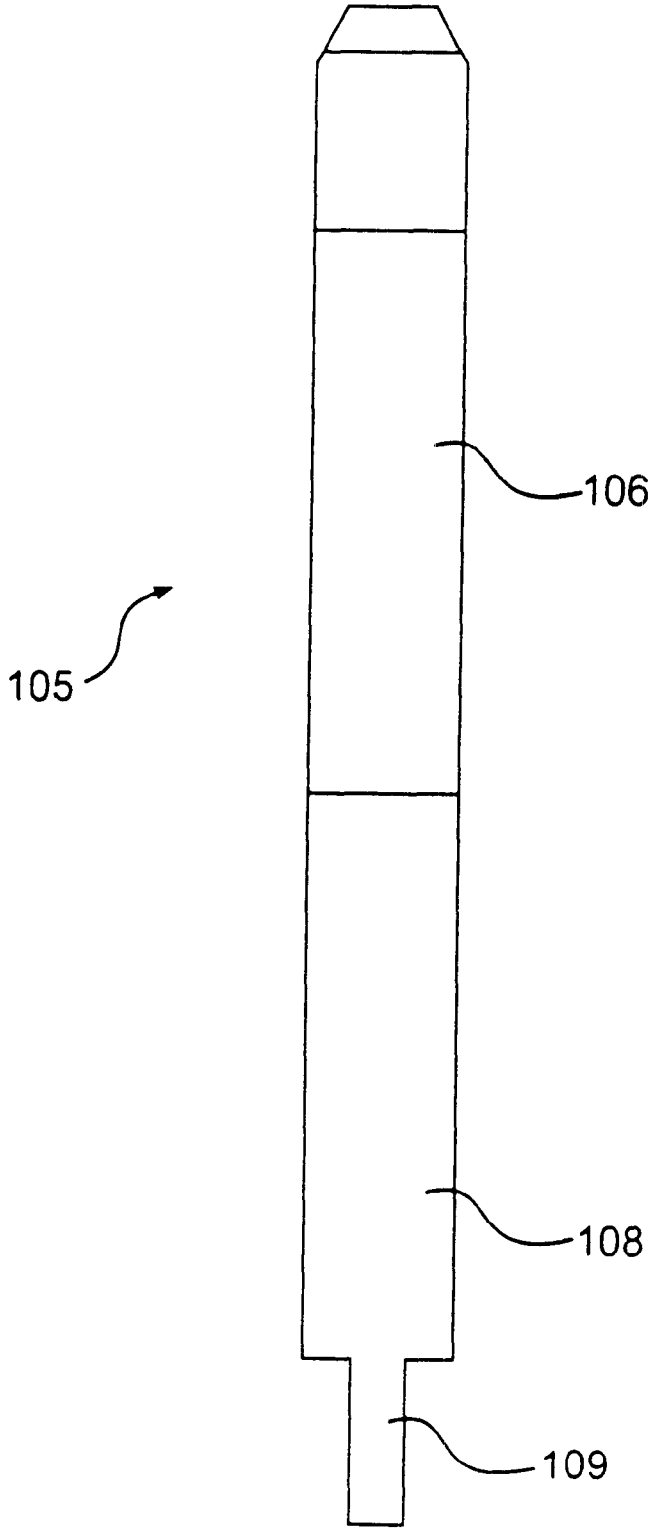

FIGS. 8A, 8B, and 8C illustrate the design of male pins 105. Male pin 105 includes a contact portion 106, a stabilizer portion 108, and a tail portion 109. The contact portion 106 includes a wedge-shaped tip 106-1 and a contact surface 106-2 for contacting the female pins 505. See, e.g., FIG. 10. The wedge-shaped tip 106-1 provides a gradual lead-in for the female pin 505 as it engages the male pin 105. A relatively narrow indent portion (not shown) may be provided between the contact portion 106 and the stabilizer portion 108. The stabilizer portion 108 serves to retain the male pin 105 in the male connector housing 110 by an interference fit. For example, the stabilizer portion 108 may sized with respect to a hole 118 such that the corners of stabilizer portion 108 dig into the material of male connector housing 110 that defines the hole 118 to retain the male pin 105 and to prevent rotation of the male pin 105 in the hole 118. The relatively thick stabilizer portion 108 isolates forces or stresses applied to the contact portion 106 from the tail portion 109 and isolates forces applied to the tail portion 109 from the contact portion 106. The forces or stresses are transferred from the stabilizer portion 108 to the male connector housing 110. The tail portion 109 facilitates contact with a substrate.

As shown in FIG. 8B, there is a slight angle, $\alpha$ for example, 1–5° and preferably 2–3°, in the contact portion 106 along the longitudinal axis of the male pin 105. The angle $\alpha$ is directed away from the contact surface 106-2 and into the buttress 115 (not shown). In one embodiments the angle $\alpha$ may be two degrees with a tolerance of 30'. The male pin 105 angles into the buttress 115 to prevent separation between the male pin 105 and the buttress 115, which is sometimes referred to as "banana peeling." Of course, the angle $\alpha$ in the male pin 105 is not necessary.

Figure 8D:
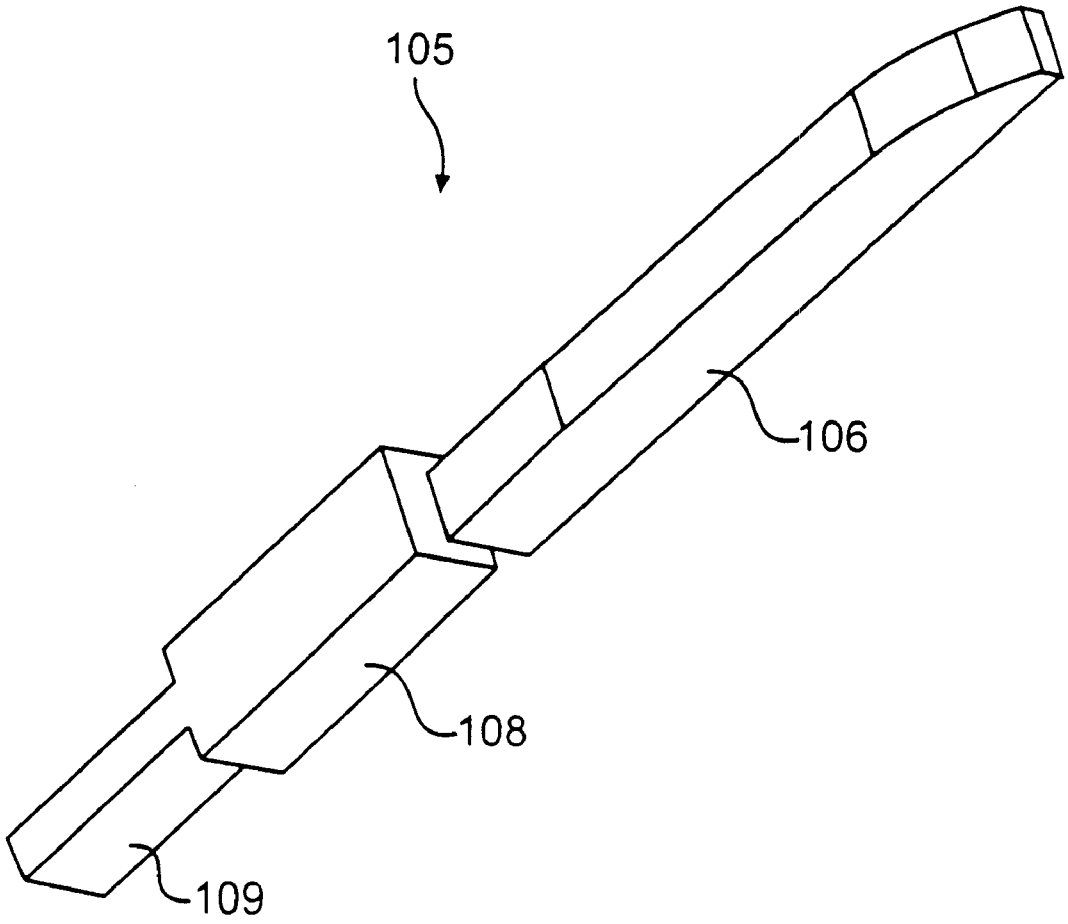
FIG. 8D illustrates a second embodiment of a male contact pin 105.

FIG. 8D illustrates a further embodiment of a male pin 105. As shown in FIG. 8D, the contact portion 106 is axially offset with respect to the stabilizer portion 108 and the tail portion 109. This offset male pin 105 can produce a connector with a very high density of contacts because the male pins 105 can be arranged close together on the buttresses 115. To secure the offset male pin 105 to the male connector housing 100, the tail portion 109 may be inserted into the holes 118 from the front face of the male connector housing 100.

Figure 9A:
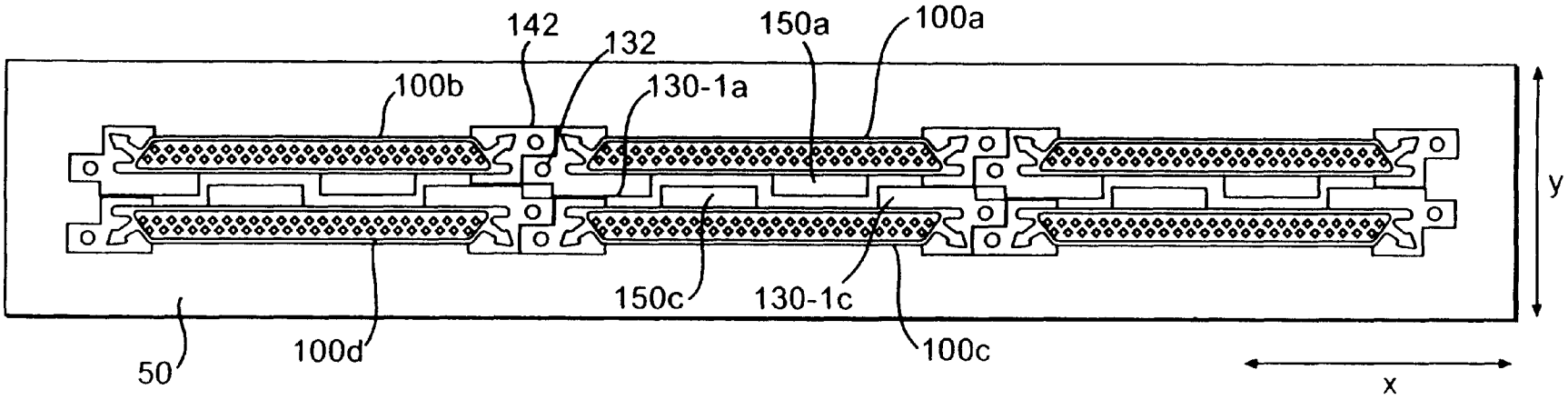
FIGS. 9A, 9B, and 9C illustrate a series of interlocking, vertical male connectors mounted to a printed circuit board 50.
Figure 9B:
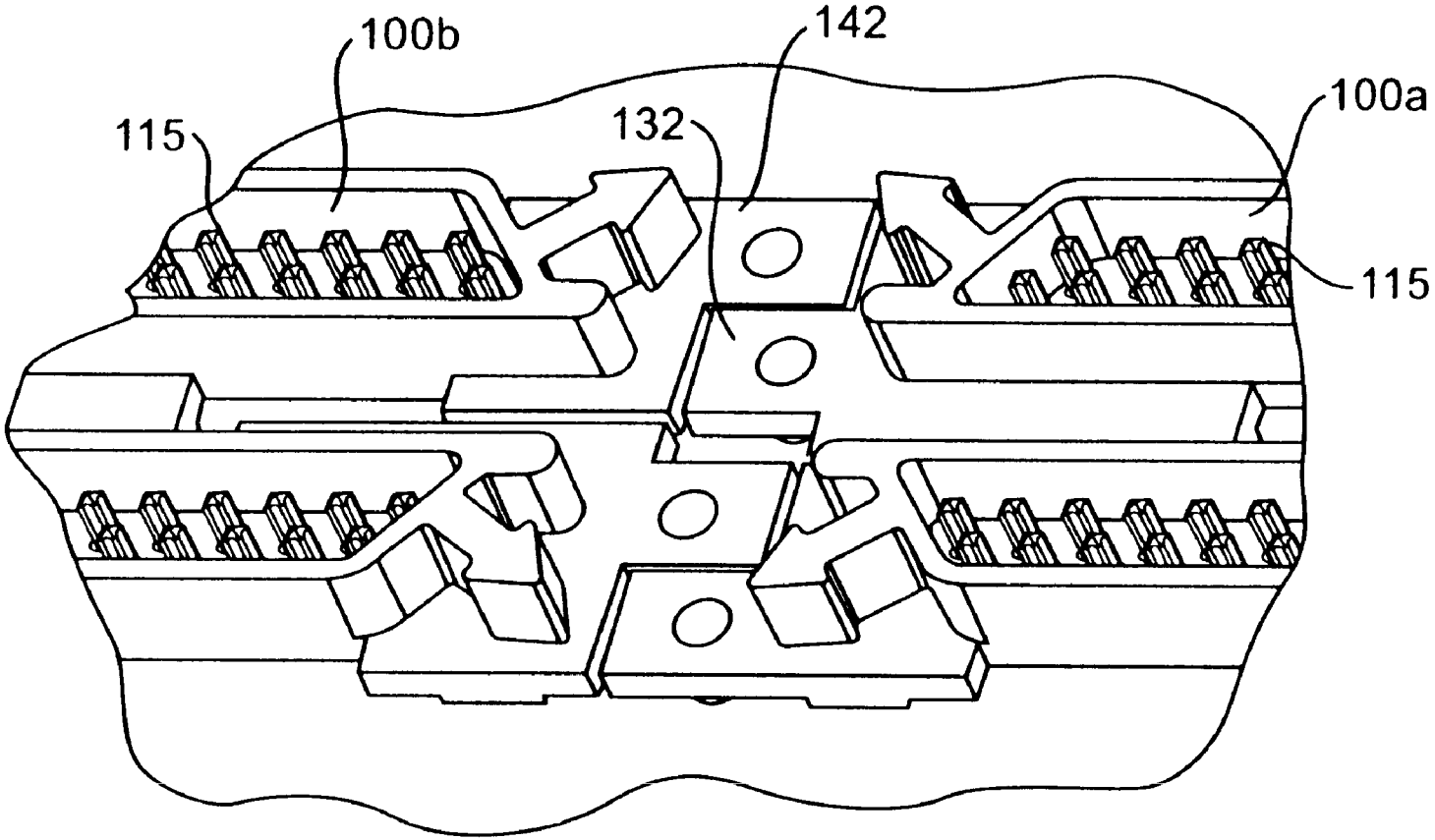

FIG. 9A illustrates two rows of three male connectors 100 mounted to a printed circuit board 50. As shown, the male connectors 100 are nested in both x and y directions to increase the density of contacts that may be provided in a given area of the substrate. FIG. 9B illustrates the nesting in the x direction or end-to-end nesting. For example, hold-down tab 132 of male connector 100*a* nests or merges with hold-down tab 142 of male connector 100*b* such that the rows of male pins 105 and rows of male pin clusters 105 of male connector 100*a* align with the rows of male pins 105 and rows of male pin clusters of male connector 100*b*.

Figure 9C:
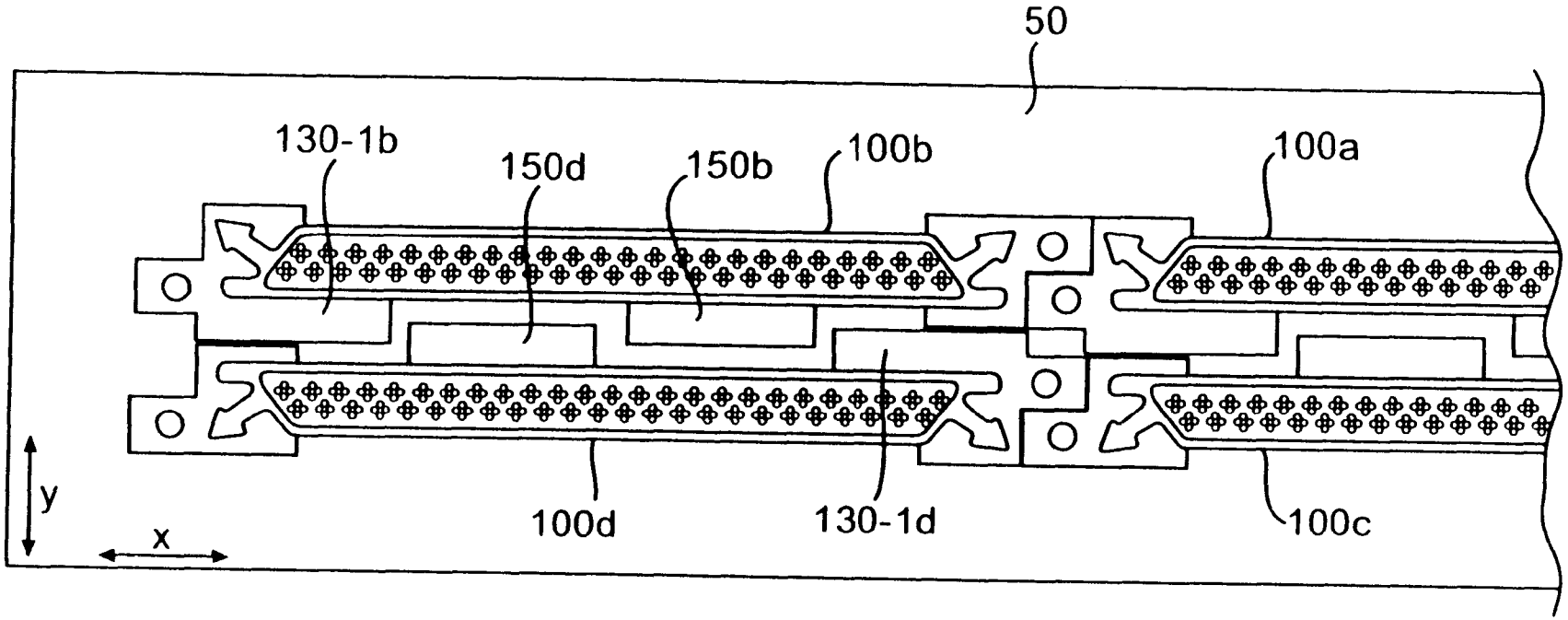

Moreover, male connector 100*a* also nests with male connector 100*c*. As shown in greater detail in FIG. 9C using male connectors 100*b* and 100*d* as examples, male connector 100*b* nests with male connector 100*d* in the y-direction, or side-to-side. The stop plate 150*b* of male connector 100*b* fits in the gap between stop plate 150*d* and side portion 130-1*d* of male connector 100*d*. While stop plate 150*b* may fit snugly in the gap, this is not necessary for purpose of the present invention. As shown in FIG. 9C, stop plate 150*b* may fit loosely in the gap. Likewise, stop plate 150*d* of male connector 100*d* fits in the gap between stop plate 150*b* and side portion 130-1*b* of male connector 100*b*. Of course, an additional single row or double row of male connectors 100 may be positioned one either side of the double row of male connectors 100 shown in FIG. 9A.

Figure 9D:
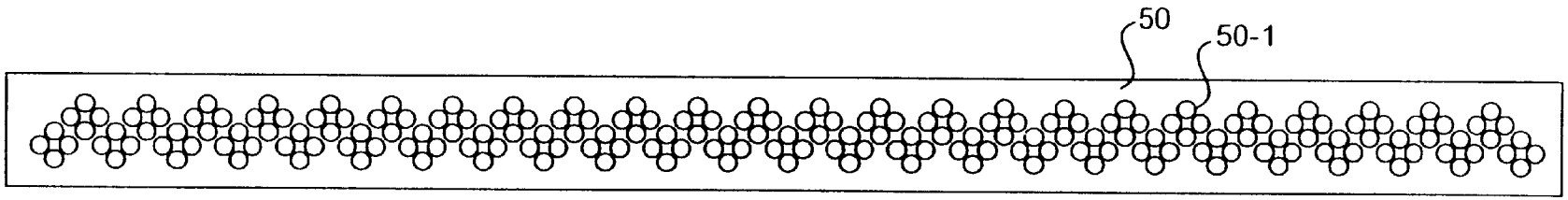
FIG. 9D shows the connector pad layout on the printed circuit board for connecting to the male contact pins 105.

FIG. 9D illustrates the male connector pad layout 50-1 of printed circuit board 50. The connector pads 50-1 contact with the tail portion 109 of male pins 105 to electrically connect the male pins 105 to the printed circuit board 50. Conductive traces (not shown) connect the connector pads 50-1 to various circuit components on the printed circuit board.

Figure 10:
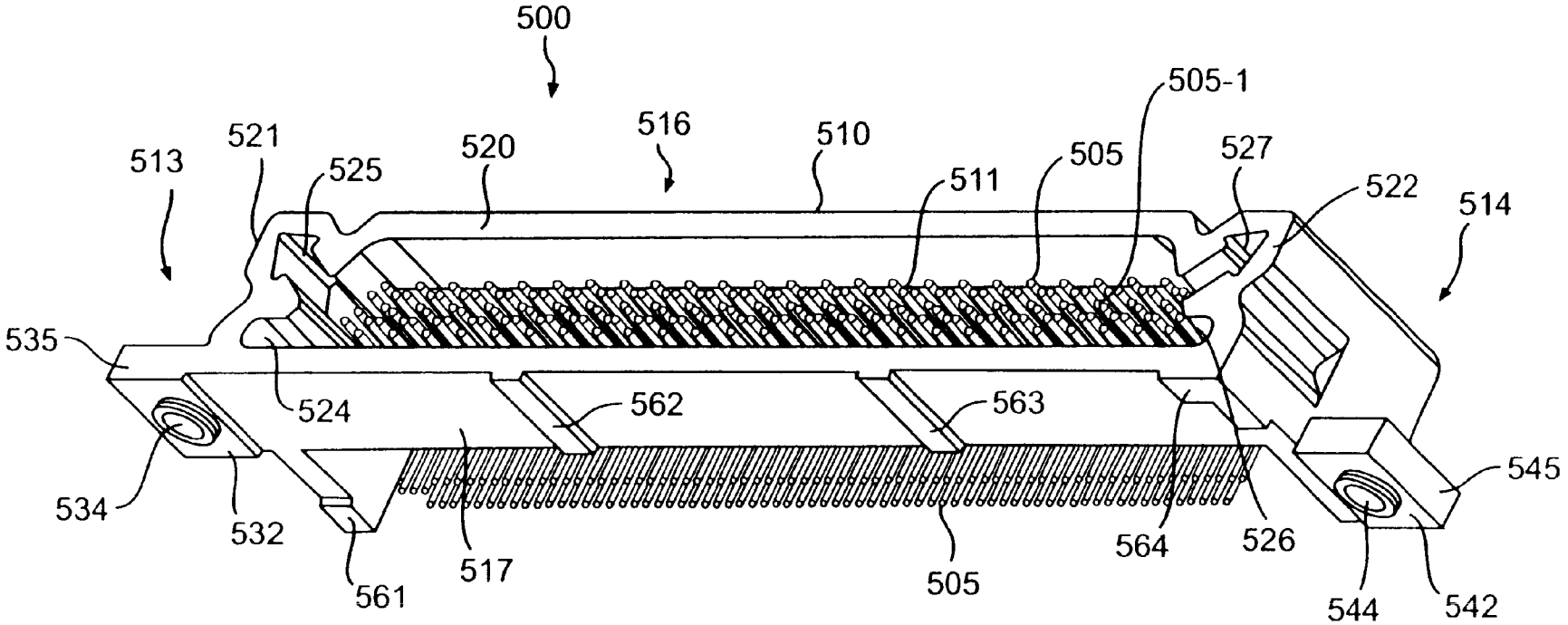
FIGS. 10, 11, 12, and 13 illustrate various views of the edge-mounted female connector in accordance with the present invention.

The female connector 500 will be described in connection with FIGS. 10-17. As shown in FIG. 10, the female connector 500 is embodied as a edge or right-angle connector and includes a female connector housing 510 and a plurality of female contact pins 505 secured in the female connector housing 510. The female connector housing 510 is formed of an insulative material, for example, a polymer or other suitable electrically insulative material. For example, a liquid crystal polymer, such as Hoechst Celanese's VECTRA™, may be used as the material for the female connector housing 510. Of course, the female connector housing 510 may include metallic shielding against noise or other interference. For example, a metallic strip or series of strips may be molded into side wall 520; or a shielding sleeve or shroud may be fitted over the female connector housing. The shielding sleeve or shroud may be formed entirely of metal or may include insulation.

Figure 11:
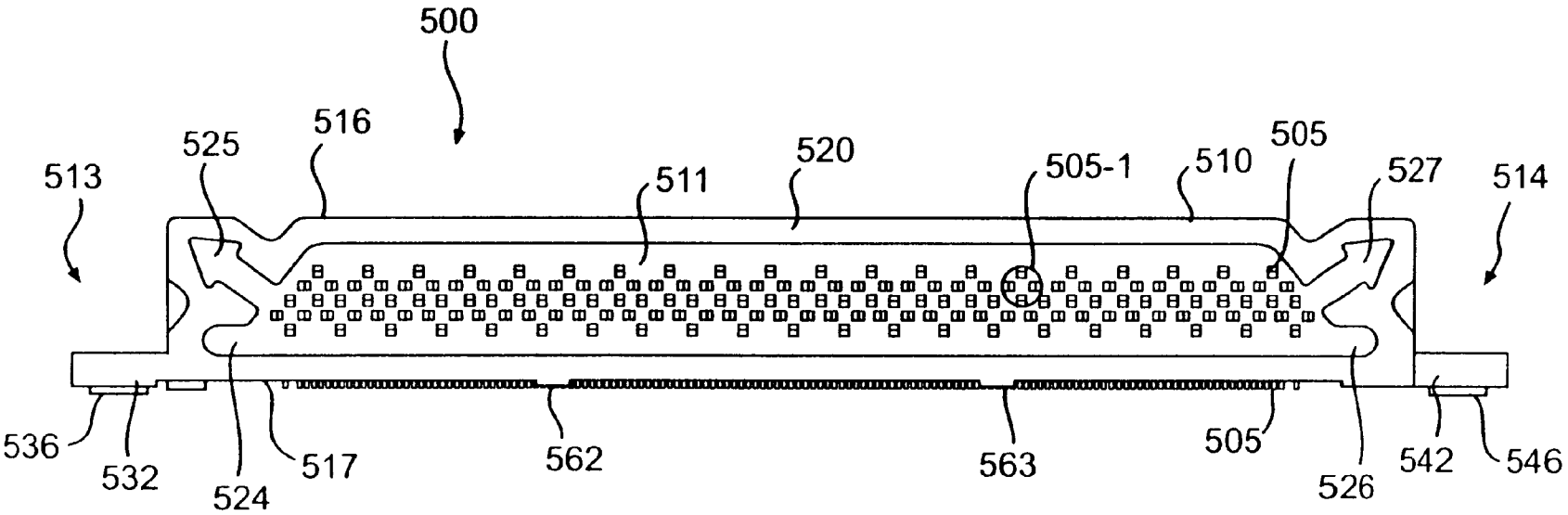

The female connector housing 510 includes a front face 511, a back face 512, a first end 513, a second end 514, a top 516, and a bottom 517. The arrangement of female pins 505 corresponds to the arrangement of male pins 105 in the male connector 100. As shown in FIGS. 10 and 11, for example, the female pins 505 are arranged in multiple rows. The female pins 505 are arranged in multiple rows and in clusters 505-1 having multiple rows at the front face 511. Each cluster may include four female pins 505. Each cluster 505-1 of female pins 505 receives a corresponding cluster 105-1 of male pins 105 and its buttress 115 when the female connector 500 and the male connector 100 are mated. Other arrangements of female pins 505 corresponding to those noted above for male pins 105 (e.g., a different number of female pins per cluster or a different arrangement of clusters) are possible consistent with the present invention.

As shown in FIG. 10, a side wall 520 may be provided on the front face 511 of the female connector housing 510 to protect the female pins 505 before, during, and after mating and in the event of mismatch. For example, the side wall 520, including end 513 and end 514, prevents the male connector 100 from damaging the female pins 505 during mismatch. The side wall 520 may continuously surround the female pins 505, as shown in FIG. 10, or may partially enclose the female pins 505. The height of the side wall 520 is preferably greater than the height of female pins 505. An interior surface of side wall 520 may be formed with a slight angle, one degree, for example, to facilitate removal from a mold during manufacture.

Side wall 520 may include polarization or keying features complementary to the polarization or keying features provided on the male connector housing 110. For example, end 521 of side wall 520 defines a rounded space or void 524 and an arrow-shaped space or void 525, and end 522 of side wall 520 defines a rounded space or void 526 and an arrow-shaped space or void 527. As shown in FIG. 10 and elsewhere, arrow-shaped space 525 generally points diagonally toward top 516 and end 513 of the female connector housing 510. Arrow-shaped space 527 generally points diagonally toward top 516 and end 514 of the female connector housing 510. Of course, the polarization features may point toward bottom 517 or embody another asymmetrical arrangement to ensure that mating between the male connector 100 and the female connector 500 may occur in only one orientation.

Side wall 520, including rounded spaces 524, 526 and arrow-shaped spaces 525, 527, receive side wall 120 of the male connector housing 110, its rounded projections 124, 126, and its arrow-shaped projections 125, 127. The combination of these features serves to guide the male and female connectors into proper alignment for mating and to prevent mating at an improper angle, at an offset, or both. The arrow-shaped spaces 525, 527 enable a user to quickly and easily identify the proper orientation of the female connector 500 for mating. Of course, one or more of ends 513, 514 may define another identifiable geometric shape, such as a circle, diamond, cross, star, square, or number, among others, or may have a combination of geometric shapes, different sizes, and/or different orientations. Alternatively, only one polarization feature may be provided.

As shown in FIG. 11, among others, the female connector housing 510 further includes a hold-down tab 532 at first end 513 and a hold-down tab 542 at second end 514. Hold-down tabs 532, 542 serve to mount the female connector housing 510 to the substrate. For example, the hold-down tabs 532, 542 may include apertures 534, 544, respectively, for receiving screws, rivets, or other fasteners to secure the female connector housing 510 to a printed circuit board or other substrate. Apertures 534, 544 may be replaced by snap connectors or other fastening devices for connecting or facilitating connection of the female connector housing 510 to a printed circuit board or other substrate.

Hold-down tab 532 is disposed proximal the front face 511 and hold-down tab 542 is disposed proximal the back face 512. Thus, hold-down tabs 532, 542 may be diagonally disposed, staggered, or offset with respect to the female connector housing 510. More particularly, a line connecting a center of aperture 534 and a center of aperture 544 crosses the longitudinal axis of the female connector housing 510 and is diagonal to the rows of female pins 505 and the rows of female pin clusters. The diagonally disposed hold-down tabs 532, 542 provide a foundation for stably securing the female connector housing 510 to the printed circuit board or other substrate without rocking or other movement. Further, hold-down tabs 532, 542 of the female connector housing 510 may be complementary to permit nesting or merging with other female connector housings 510. Of course, the hold-down tabs are not required for some applications, e.g., if the female connector is small.

Figure 12:
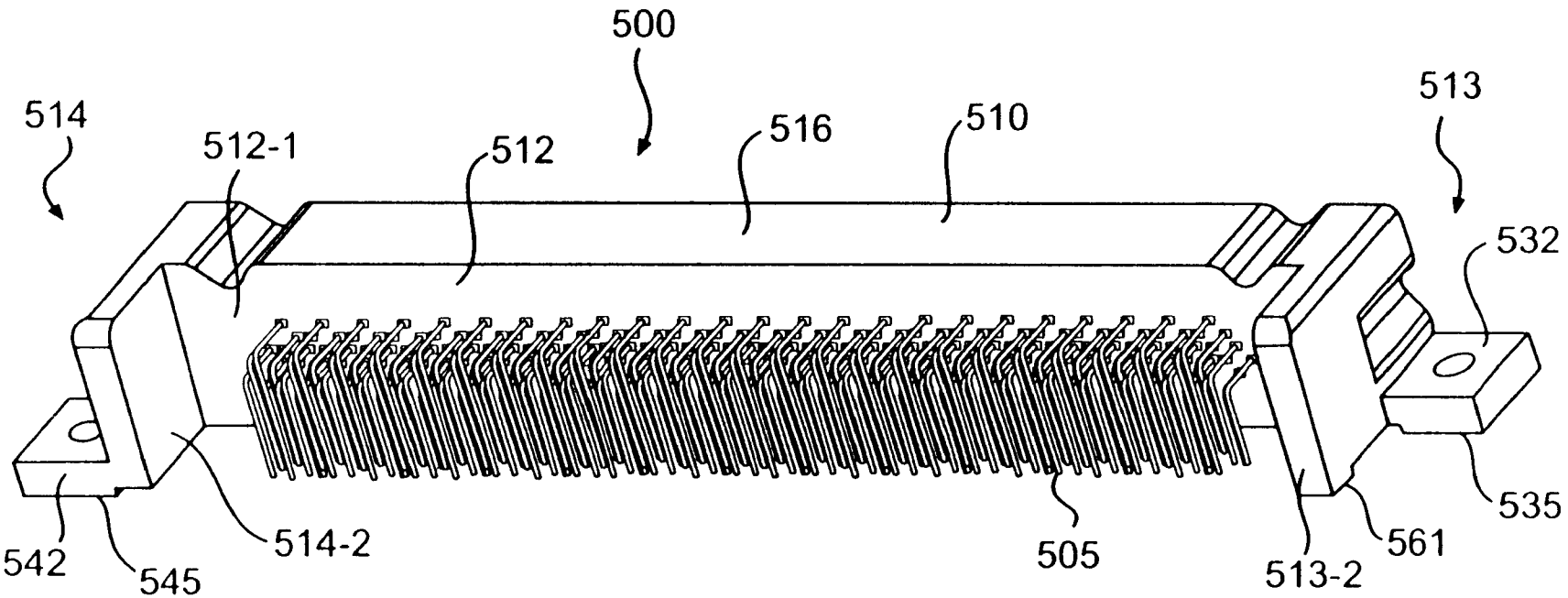
Figure 13:
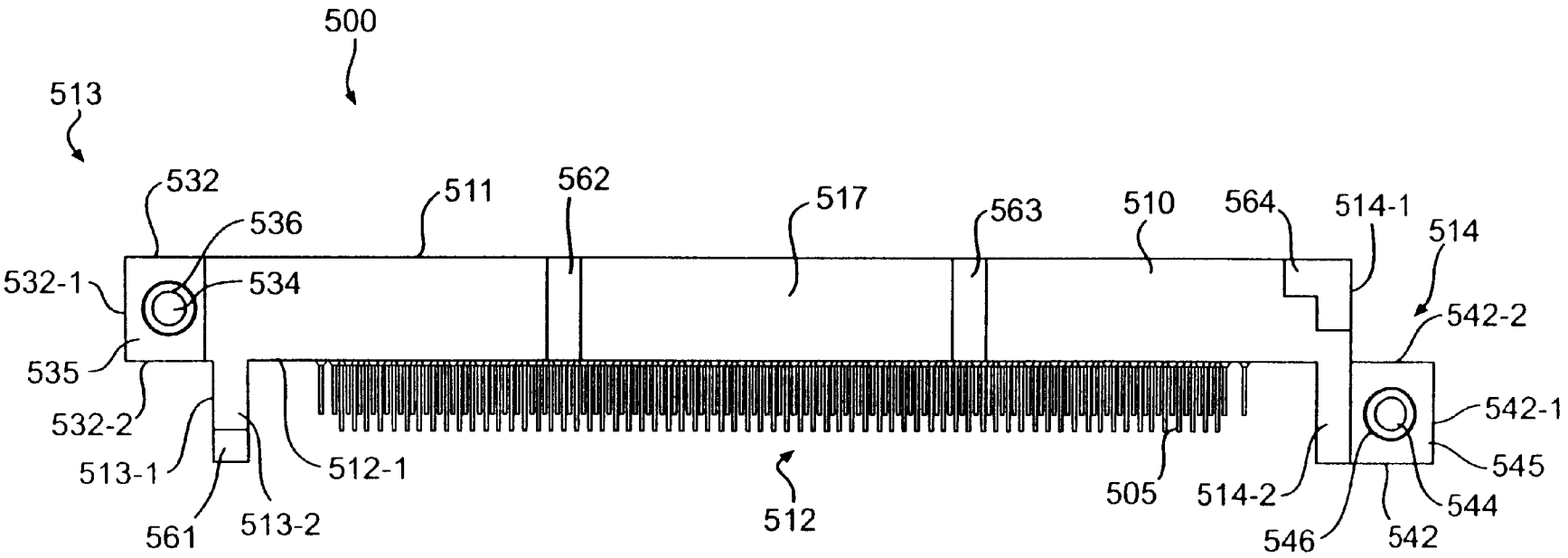

FIGS. 12 and 13 illustrate the back face 512 and bottom 517 of the female connector 500. Female pins 505 exit the female connector housing 510 at back surface 512-1 and then extend down, e.g., at a right angle, to the substrate (not shown). Ends 513, 514 include end supports 513-2, 514-2 extending from the back surface 512-1. As shown in FIG. 12, for example, hold-down tab 542 extends from end support 514-2 yet provides clearance for assembly.

As shown in FIG. 13, for example, the bottom 517 includes a generally flat surface having elevated stand-offs 535, 545, 561, 562, 563, and 564. The stand-offs balance the female connector housing 510 on the surface of the printed circuit board or other substrate and permit air flow between the bottom 517 and the printed circuit board or other substrate.

Stand-offs 535, 545 extend from hold-down tabs 532, 542, respectively. Stand-offs 535, 545 may include guide sleeves 536, 546 at apertures 534, 544, respectively, for seating within apertures formed in the substrate to accurately position the female connector housing 510. The female connector housing 510 may further include posts (not shown) extending from the bottom surface for further positioning the female connector 510 and guiding it into the substrate.

Figure 14A:
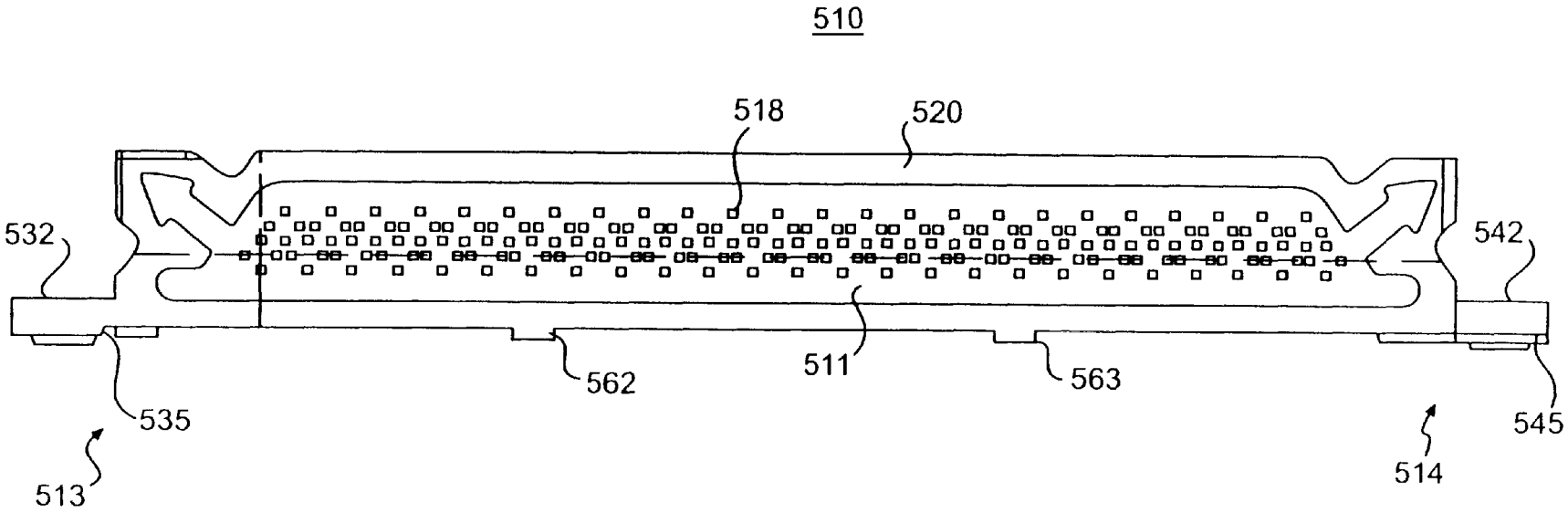
FIG. 14A illustrates the front face of the edge-mounted female connector housing 510.
Figure 14B:
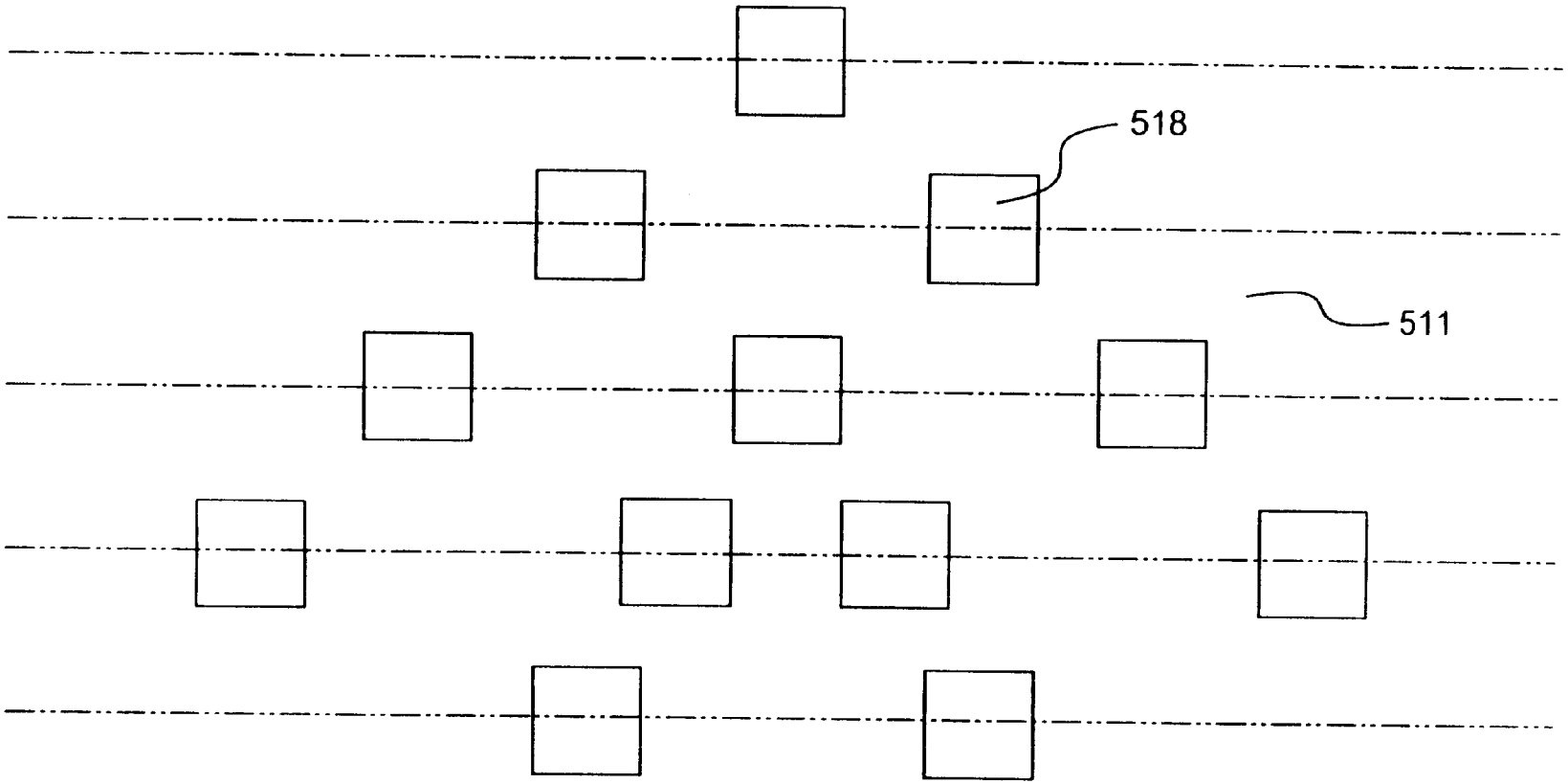
FIG. 14B illustrates the front face of the female connector housing 510.

FIG. 14A illustrates the female connector housing 510 before female pins 505 are inserted. FIG. 14B illustrates the holes 518 formed through the female connector housing 510 for holding female pins 505. The holes 518 are rectangular (in particular, square) and arranged in clusters, e.g., clusters of four. Of course, the holes 518 may be another shape, for example circular, so long as female pins 505 are securely held within the female connector housing 510. In one embodiment of the invention, an axis of each hole 518 is perpendicular to a surface of the female connector housing 510 through which the hole 518 is formed. FIG. 14B illustrates five parallel lines or rows 1, 2, 3, 4, and 5 defined by the arrangement of holes 518, in contrast to the six lines of conventional designs. Manufacture is simplified because the automated pin insertion machine makes only five passes along the length of the female connector housing 510 to fill each of the holes. In addition, the length of the tail portions of the female contacts 505 may be reduced because the distance from the holes 518 to the substrate is reduced when five rows of leads are used.

Figure 14C:
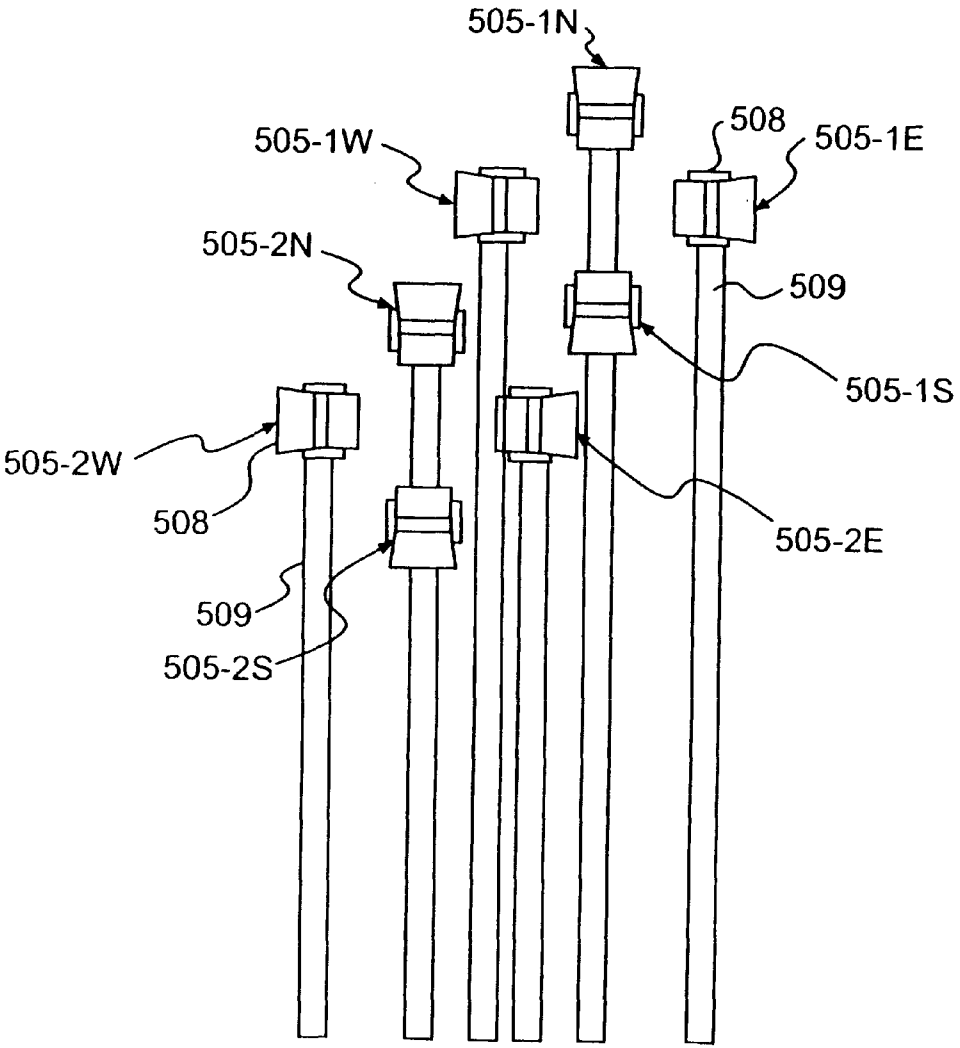
FIG. 14C illustrates two clusters of female contact pins 505 as they would be arranged when inserted into the female connector housing 510.

FIG. 14C shows two clusters of female pins 505 as they would be arranged in holes 518. A first cluster includes female pins 550-1N, 505-1S, 505-1W, and 505-1E and a second cluster includes female pins 505-2N, 505-2S, 505-2W, and 505-2E. In connection with the female pins, an "N" is used to designate a female pin 505 having a downwardly facing contact surface, an "S" is used to designate a female pin 505 having a contact surface facing up, a "W" is used to designate a female pin 505 having a contact surface facing to the right, and an "E" is used to designate a female pin 505 having a contact surface facing to the left. As shown in FIG. 14C, the first cluster of female pins overlaps with the second cluster of female pins. In particular, female pin 505-1W of the first cluster is located to the left of female pin 505-2E.

Figure 14D:
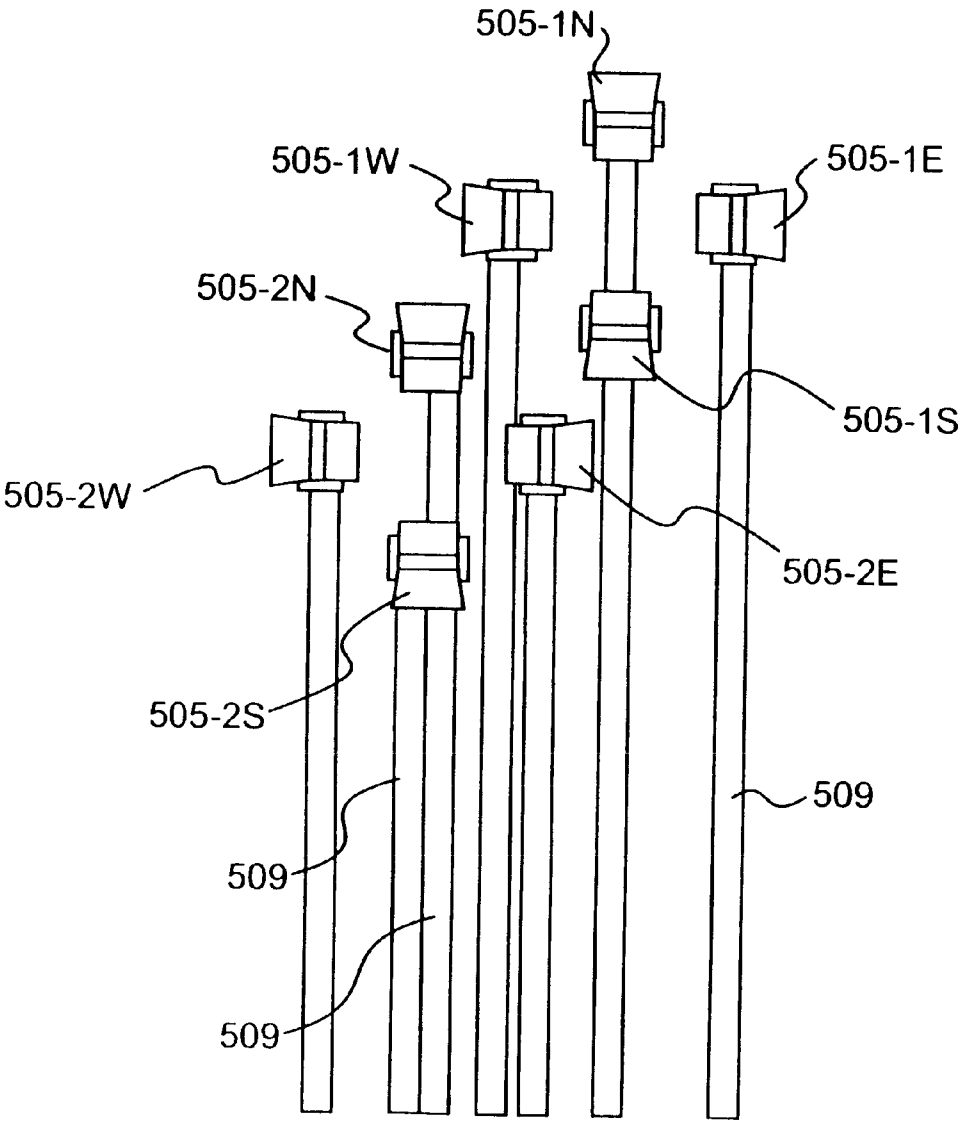
FIGS. 14D and 14E illustrate a second arrangement of female contact pins 505 as they would be arranged when inserted into the female connector housing 510.
Figure 14E:
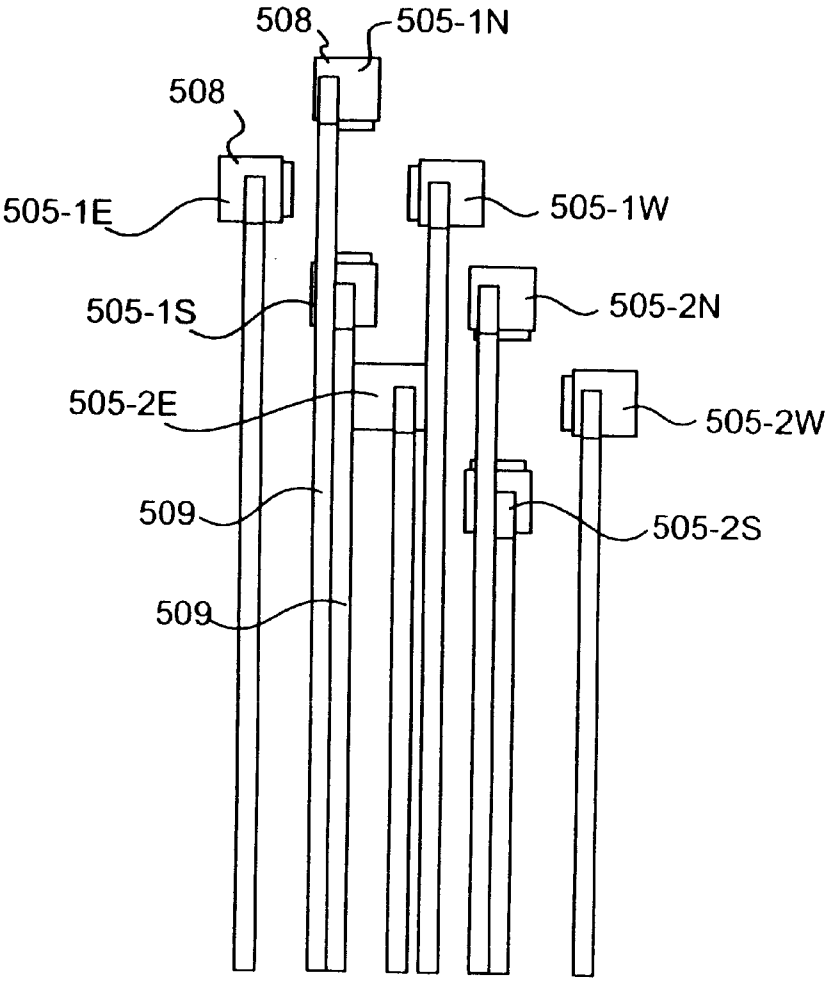

FIG. 14C shows the tail portions 509 of the female pins to be axially aligned with the stabilizer portion 508 of the female pins. FIGS. 14D and 14E illustrate a second embodiment of the female pins 505 in which the tail portions 509 of the female pins 505 are axially offset with respect to a stabilizer portions 508 of the female pins 505. As a consequence, the tail portion of female contact pin 505-2N and the tail portion of female contact pin 505-2S are laterally offset from one another as shown in FIG. 14D, for example, in contrast to the arrangement in FIG. 14C, which shows that the tail portions of female contact pins 505-2N and 505-2S are aligned.

FIG. 14E provides a rear view of the clusters of female contact pins 505 shown in FIG. 14D. As shown, the axis of the tail portion 509 of the female contact pins 505 does not extend from the center of the stabilizer portion 508 of the female contact pins 505, but is offset from the center. As a consequence, for example, the tail portions 509 of female contact pins 505-1N and 505-1S are laterally offset. Of course, the axis of the tail portion 509 of the female pins may be offset in the direction of any of the sides or corners of the stabilizer portion.

Figure 14F:
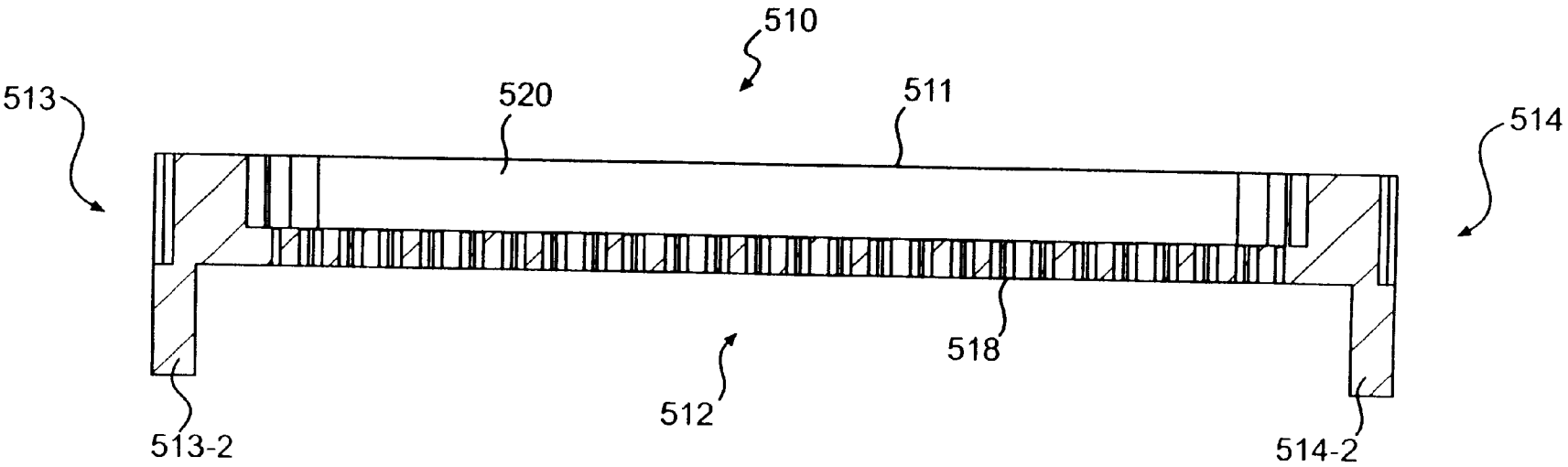
FIG. 14F illustrates a cross section of the female connector housing 510.

FIG. 14F illustrates a cross section of female connector housing 510. As shown, the holes 518 extend through the female connector housing 510. The female contact pins 505 may be inserted into the holes 518 of the female connector housing row-by-row beginning either from the top row or the bottom row.

Figure 15A:
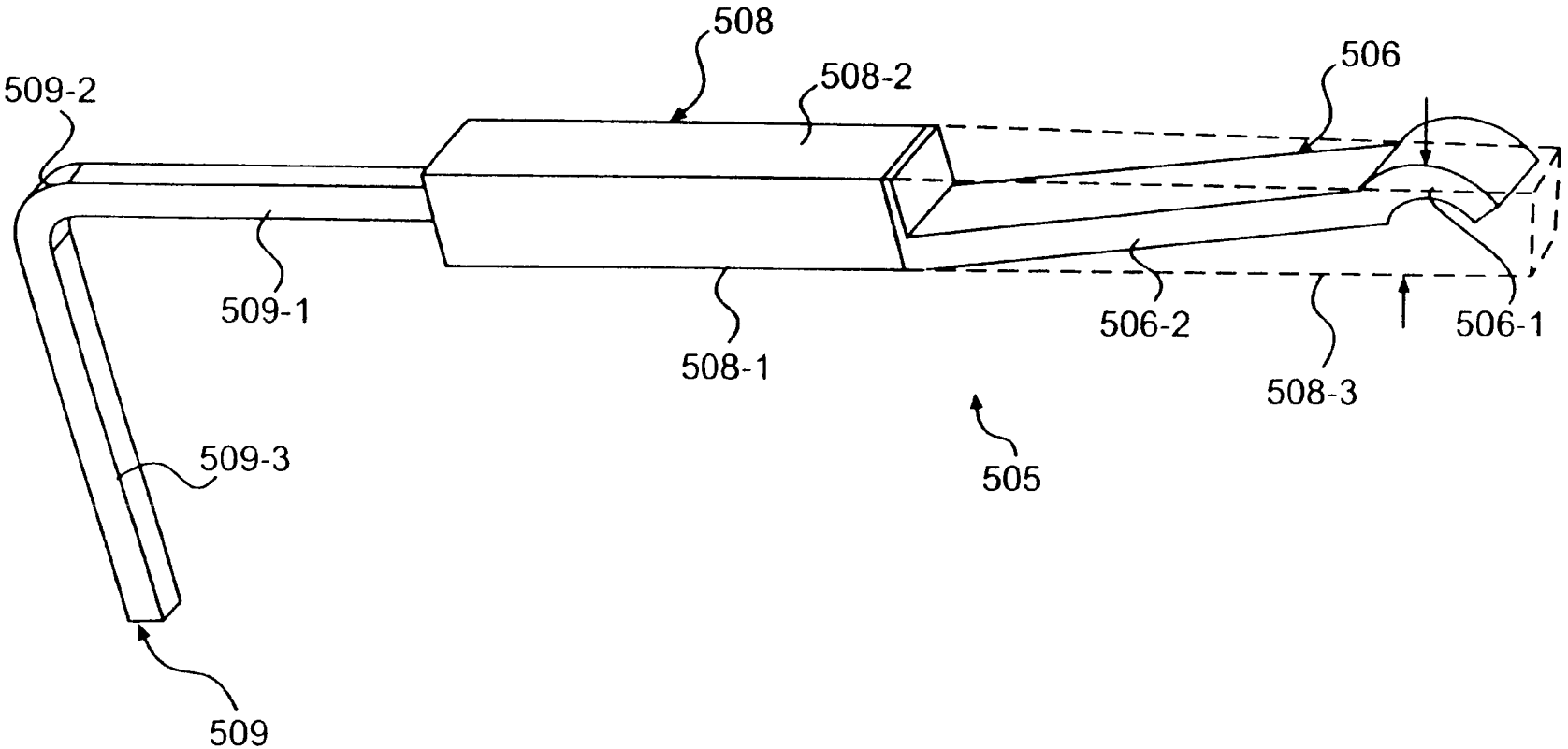
FIGS. 15A, 15B, and 15C illustrate a first embodiment of a female contact pin 505.
Figure 15B:
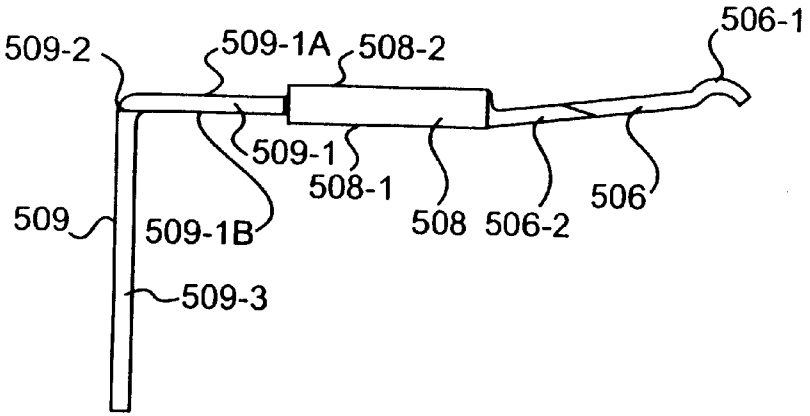
Figure 15C:
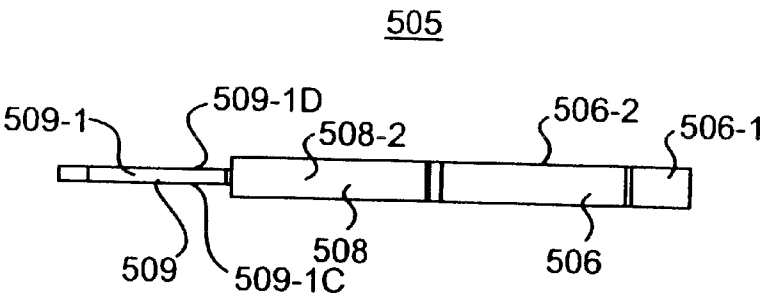

FIGS. 15A, 15B, and 15C illustrate an example of female pin 505. Female pin 505 includes a contact portion 506, a stabilizer portion 508, and a tail 509. The stabilizer portion 508 is securely held by the female connector housing 510, for example, by an interference fit between the stabilizer portion 508 and the female connector housing 510. For example, the stabilizer portion 508 may be sized with respect to a hole 518 so that the corners of stabilizer portion 508 dig into the sides of hole 518 to retain the female pin 505 and to prevent rotation or push-out. Alternatively, the stabilizer portion 508 may be sized with respect to a hole 518 so that the sides of stabilizer portion 508 fit tightly or frictionally engage the sides of hole 518 to retain the female pin 505 and to prevent rotation. Contact portion 506 is extends from the stabilizer portion 508 toward the front face 511 of the female connector housing 510 and tail 509 extends from the stabilizer portion 508 toward the back face 512.

The contact portion 506 is adapted to engage the contact portion 106 of a male pin 105 to establish an electrical connection therebetween. Contact portion 506 includes a tip 506-1 and a flexible beam 506-2 that is linear or straight Tip 506-1 provides a gradual lead-in to facilitate insertion and contact between the female pin 505 and its corresponding male pin.

The flexible beam 506-2 couples to an end of the stabilizer portion 508 at a first side thereof 508-1 and angles toward a second side 508-2 of the stabilizer portion 508. As shown in FIG. 15A, for example, the unflexed contact portion 506 remains substantially within an envelope 508-3 defined by a projection of the outer periphery of the stabilizer portion 508. For example, in one preferred embodiment, the width of the stabilizer portion 508 orthogonal the longitudinal axis of the stabilizer portion 508 between the first side 508-1 and the second side 508-2 is 0.022 inches (0.56 mm). The angled flexible beam 506-2 spans a width of 0.026 inches (0.66 mm) in the same direction. In accordance with the present invention, the span of the flexible beam 506-2 may differ from the width of the stabilizer portion 508 by about 0.010 inches (0.254 mm) and still facilitate easy insertion. However, it is preferable that the difference in width does not exceed 0.005 inches (0.127 mm). The flexible beam 506-2 and the stabilizer portion 508 each span a width of 0.022 inches (0.56 mm) along the first or second sides 508-1, 508-2 in a direction orthogonal to the longitudinal axis of the stabilizer portion 508. Of course, the angled female beam 506-2 may span a maximum distance in any direction that is equal to or less than the width of the stabilizer portion 508.

The female pin 505 can be inserted into a hole 518 of the female connector housing 510 by aligning the axis of the stabilizer portion 508 with an axis of a hole 518 and pushing the contact portion 506 straight through the hole 518. There is no need for complex movement to insert the contact portion 506 through the hole 518.

The flexible beam 506-2 is capable of flexing toward side 508-1 of the stabilizer portion 508 when engaged with a male pin 105. The flexibility of flexible beam 506-2, and thus the contact normal force with the male contact portion, can be adjusted, for example, by making the flexible beam 506-2 thicker or thinner and/or by selecting a material having appropriate flexibility for the female pin 505. For example, the flexible beam 506-2 may be flexed so that it aligns with side 508-1 of the stabilizer portion 508. The flexible beam 506-2 is preferably, but not necessarily, thinner than the contact portion of the male pin. This will cause the female pin to flex more than the male pin.

Tail 509 includes a horizontally-extending section 509-1 extending from the stabilizer portion 508, an elbow 509-2, and a vertically-extending section 509-3. Of course, for vertical-mounting female connectors, the female pins 505 do not require the elbow 509-2 and the vertically-extending section 509-3. As shown in FIGS. 15B and 15C, the periphery of the horizontally-extending portion 509-1 is displaced from the periphery of the stabilizer portion 508 in directions perpendicular to the longitudinal axis of the stabilizer portion 508. More particularly, the horizontally-extending portion 509-1 has a first side 509-1*a*, a second side 509-1*b*, a third side 509-1*c*, and a fourth side 509-1*d*. As shown in FIG. 15B, the first side 509-1*a* and the second side 509-1*b* are not coplanar with the corresponding top and bottom of the stabilizing portion 508. Similarly, as shown in FIG. 15C, the third side 509-1*c* and the fourth side 509-1*d* are not coplanar with corresponding sides of the stabilizing portion 508.

The vertically-extending section 509-3 is adapted for contacting a substrate, such as a printed circuit board. The horizontally-extending section 509-1 is capable of flexing to accommodate variations in the surface of a substrate to which the female connector 500 is mounted. The length of horizontally-extending section 509-1 and the length vertically-extending section 509-3 may vary depending on the position of the female pin 505 in the female connector housing 505 and the design of the pad layout on the substrate. For example, the vertically-extending section 509-3 of an "N"-type female pin may be longer than the vertically-extending section 509-3 of an "S"-type female pin. In addition, the vertically-extending section 509-3 of a female pins in an upper row should be longer than the vertically-extending section 509-3 of a corresponding female pin in a lower row.

The female pin 505 shown in FIG. 15A is an "S"-type pin. Of course, the vertically-extending section 509-1 of tail 509 may be directed in other directions to form "N", "W", and "E"-type pins. In addition, the tail 509 shown in FIG. 15A, for example, has a rectangular cross section, and specifically a square cross section. However, the tail may have a circular or otherwise rounded cross section.

Because they are narrower than the stabilizer portion 508, the contact portion 506 and the tail portion 509 will flex in response to an applied force. The stabilizer portion 508 isolates the stresses applied to the contact portion 506 from affecting the tail portion 509 and isolates stresses applied to the tail portion 509 from affecting the contact portion 506.

As discussed in greater detail below, female pins 505 may be mounted on a bandolier used to feed female pins 505 for automated insertion into holes 518 in a manner analogous to that discussed above in connection with the male pins.

Figure 15D:
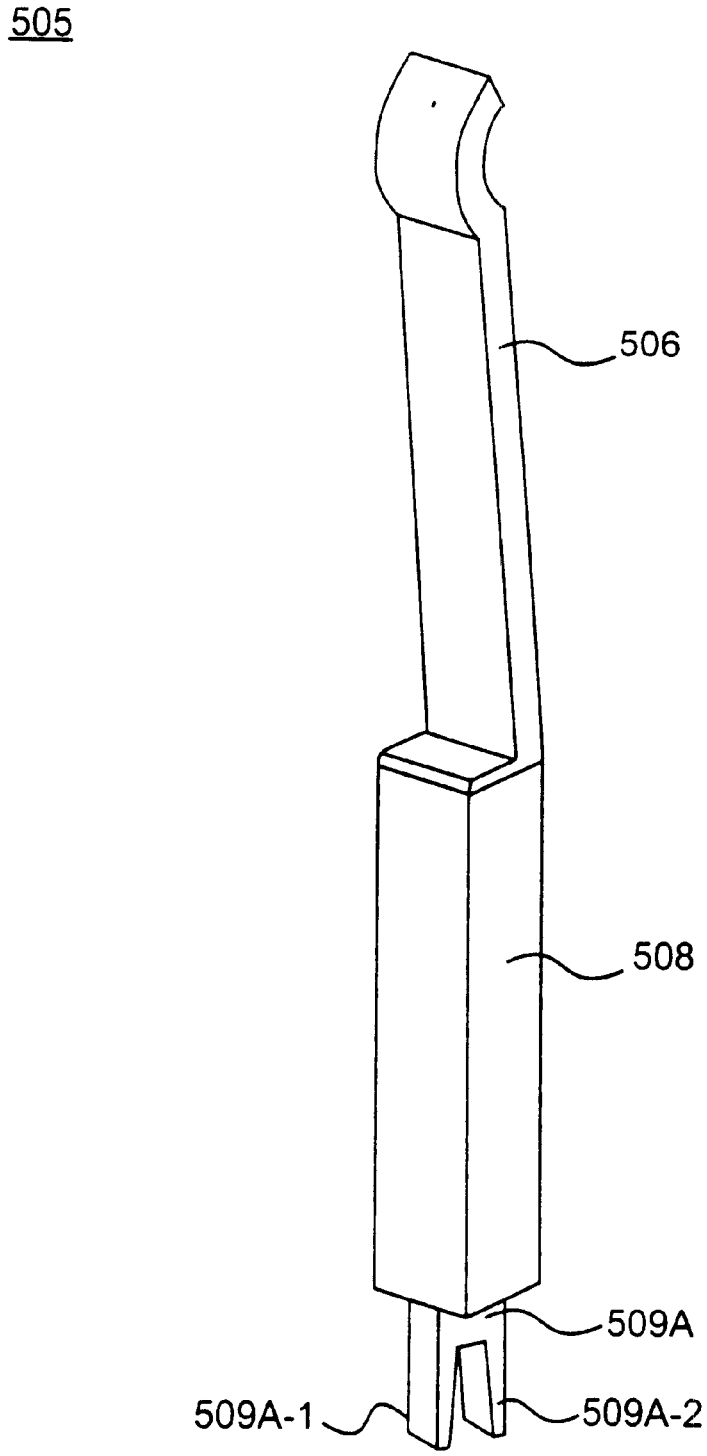
FIG. 15D illustrates a second embodiment of a female contact pin 505.

FIG. 15D illustrates a further embodiment of a female contact pin 505. The contact portion 506 and the stabilizer portion 508 are identical to that of the first embodiment of the female contact pin 505 shown in FIGS. 15A–15C. In FIG. 15D, the tail portion 509*a* forks into two prongs 509*a*-1 and 509*a*-2. The interior edges of the prongs 509*a*-1 and 509*a*-2 have a sharp surface for cutting into the insulation surrounding an individual wire. Thus, the tail portion 509*a* is adapted for direct connection to an individual wire.

Figure 16A:
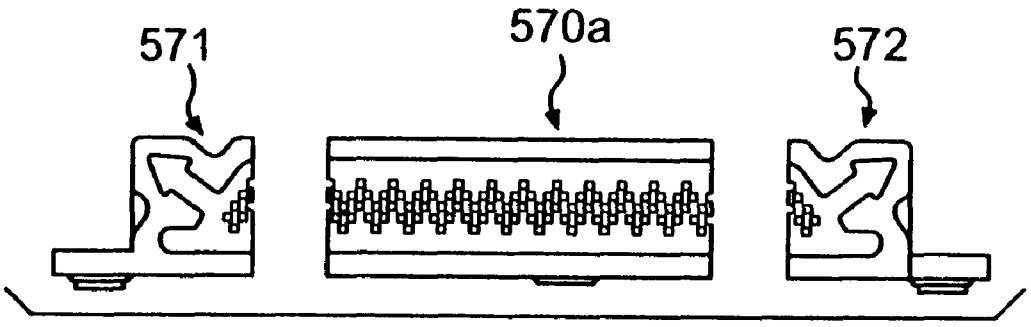
FIGS. 16A and 16B illustrate a modular design for manufacturing female connector housings with a varying number of female contact pins.
Figure 16B:
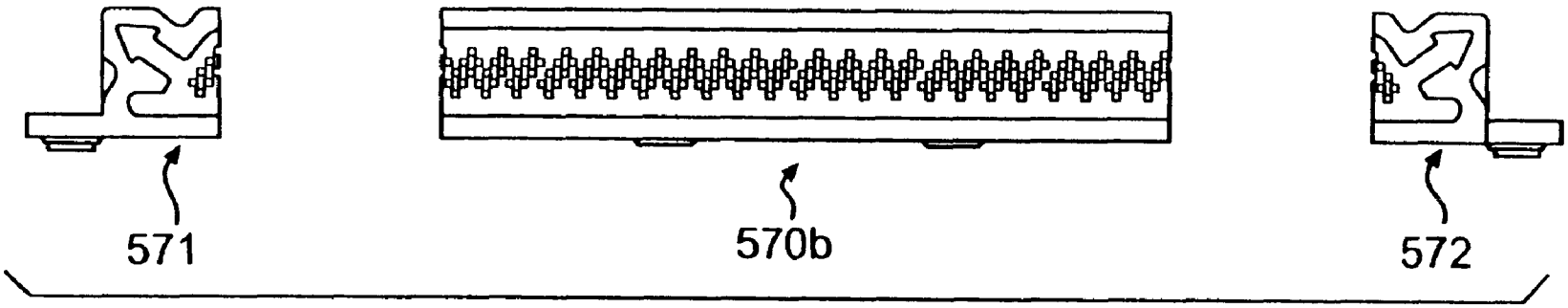

FIGS. 16A and 16B illustrate a modular design for manufacturing female connector housings with a varying number of female pins 505. As shown in FIG. 16A, end pieces 571, 572 connect to opposite ends of center piece 570*a* to form female connector housing 510 for supporting a given number of female pins 505. Alternatively, FIG. 16B shows that end pieces 571, 572 may be connected to center piece 570*b* to form a female connector housing 510. Center piece 570*a* has a shorter length than center piece 570*b* and supports fewer female pins 505. Different center pieces may be selected based on connector length and on density of female pins 505. The end pieces 571, 572 may be adhesively bonded to the center piece 570 or may be formed with the center piece 570 in a modular mold. As evident from FIGS. 16A and 16B, end pieces 571 and 572 may be connected together to form a connector housing having a minimum length and minimum number of contacts.

The modular connector shown in FIGS. 16A and 16B may be manufactured by molding the end pieces 571, 572 as a single connector housing. The single connector housing may then be cut in half to form the end pieces 571 and 572. A separately molded center piece 570 may then be bonded to the end pieces 571, 572. Of course, male connector 510 may be formed with a modular design similar to that discussed above.

Figure 16C:
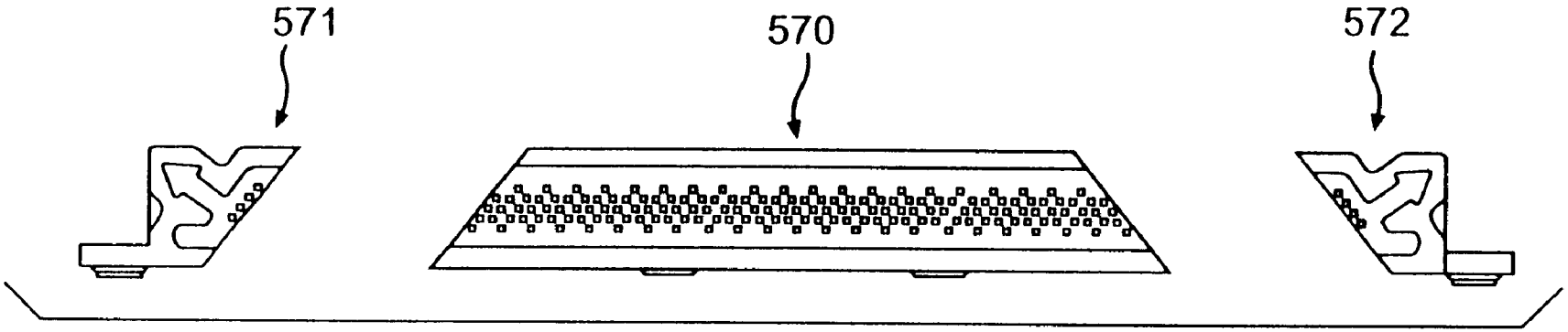
FIG. 16C shows an alternative embodiment of a female connector housing having a modular design.

FIG. 16C illustrates a second embodiment of the female connector housing having a modular design. Unlike the embodiment shown in FIGS. 16A and 16B, the end pieces 571, 572 shown in FIG. 16C have angled sides for joining to the center piece 570. The center piece 570 has angled sides that are complementary to the angled sides of the end pieces 571, 572. Because of the angled sides, the end pieces 571, 572 cannot be joined together to form a female housing. Of course, the angled sides of end pieces 571, 572 may be complementary to permit joining together.

Figure 17A:
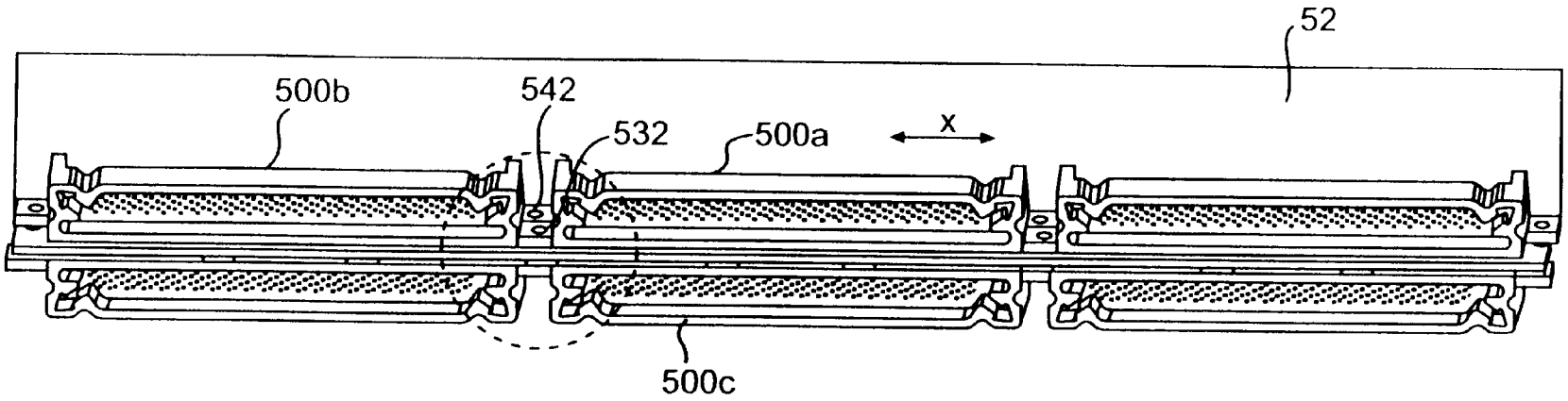
FIGS. 17A and 17B illustrate rows female connectors mounted on opposite sides of a printed circuit board.
Figure 17B:
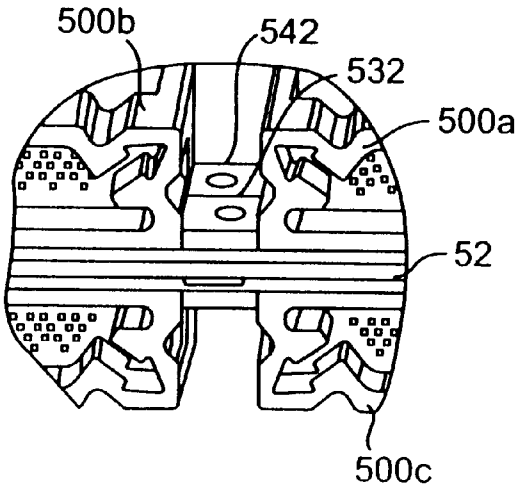

FIGS. 17A and 17B illustrate female: connectors 500 mounted on opposite sides of a printed circuit board 52. As shown, the female connectors 100 are nested or merged in the x direction so that more connections may be provided along a given length of the substrate edge. By way of example, hold-down tab 532 of female connector 500*a* nests or merges with hold-down tab 542 of female connector 500*b* such that the rows of female pins or rows of clusters of female pins of both connectors are aligned. Female connector 500*c* may be mounted to the opposite side of printed circuit board 52 from female connector 500*a* such that the female pins or clusters of female pins of both connectors are aligned.

Moreover, the holes 534, 544 of the female connectors may be aligned so that a single fastener may be used to secure multiple female connectors to the printed circuit board 52 or other substrate. For example, hole 534 of female connector 500*b* may be aligned with hole 544 of female connector 500*c* so that a single fastener (e.g., a bolt and nut) may be used to couple the respective hold-down tabs of female connectors 500*b* and female connector 500*c* to the printed circuit board 52.

Figure 17C:
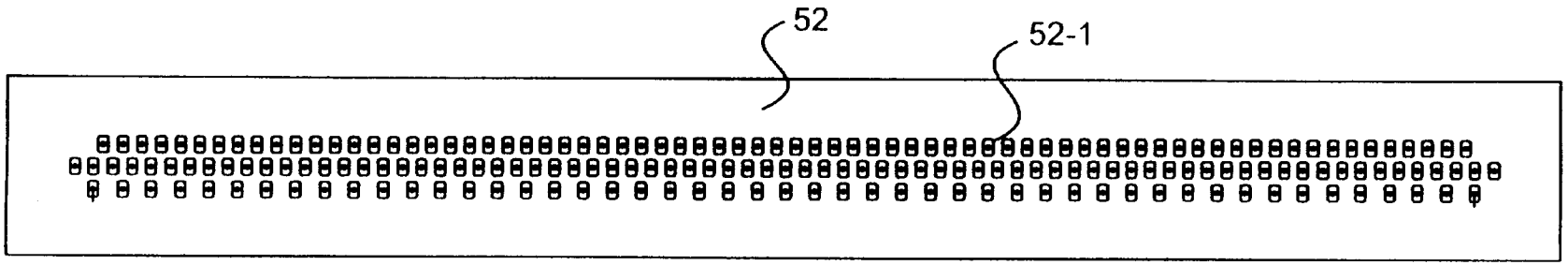
FIG. 17C shows the connector pad, layout on the printed circuit board for connecting to the female contact pins.
Figure 18:
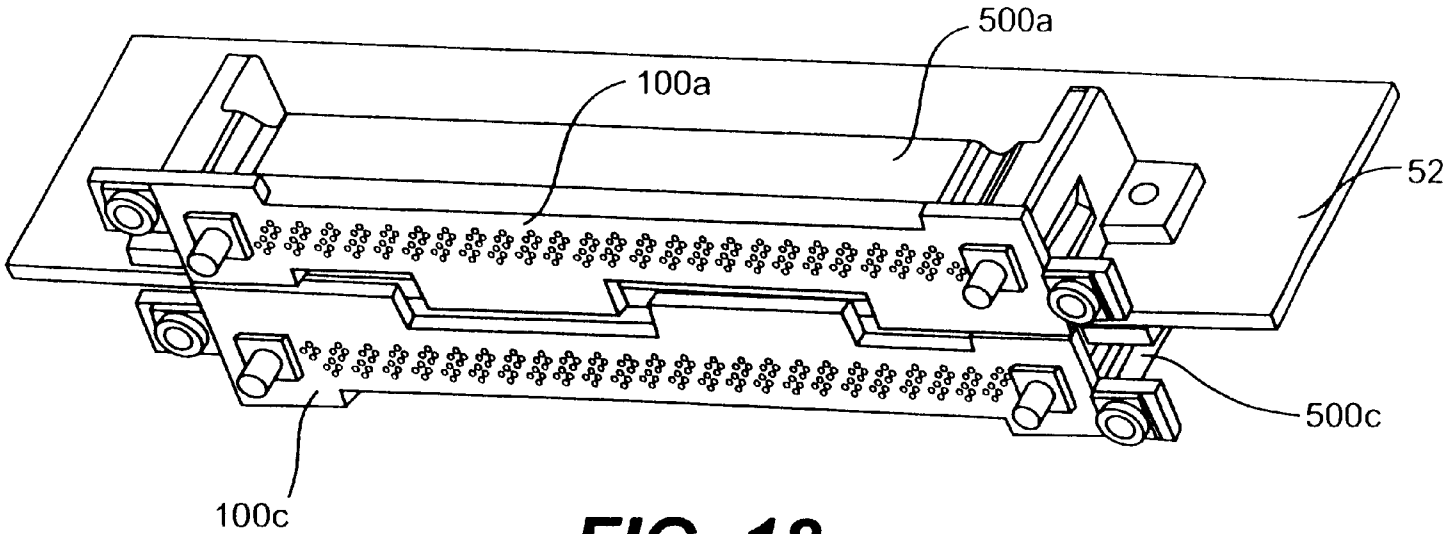
FIGS. 18, 19, 20, and 21 illustrate the mating connection between the male connectors and the female connectors.

FIG. 17C illustrates the female connector pad layout 52-1 of printed circuit board 52. The connector pads 52-1 contact with the tail portion 509 of female pins 505 to electrically connect the female pins 505 to the printed circuit board 52. Conductive traces (not shown) connect the connector pads 52-1 to electrical components on the printed circuit board 52.

Figure 19:
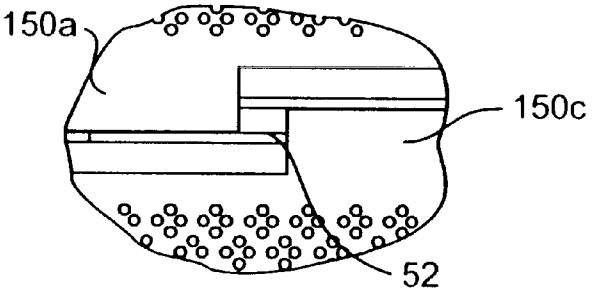
Figure 20:
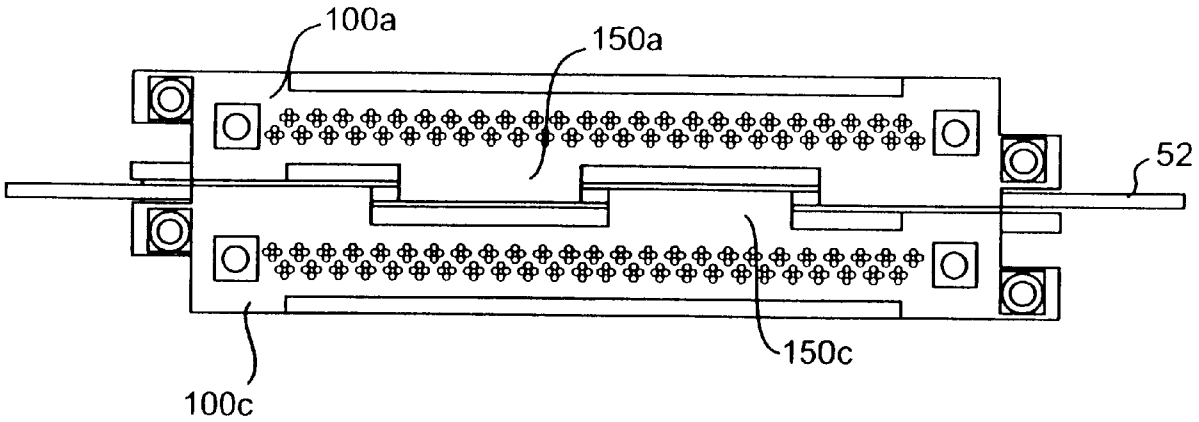
Figure 21:
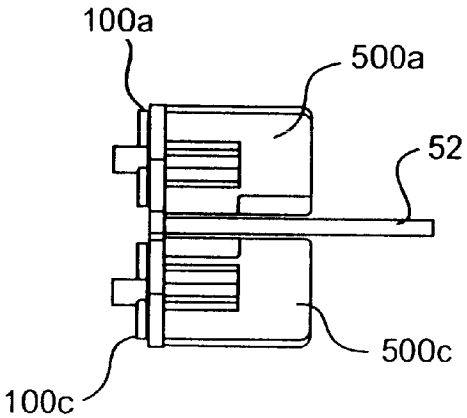

FIGS. 18, 19, 20, and 21 illustrate the mating connection between the male connectors 100*a*, 100*c* and the female connectors 500*a*, 500*c*. The printed circuit board 50 to which the male connectors 100*a*, 100*c* are attached is omitted for clarity. As shown in FIG. 19, printed circuit board 52 abuts against stop members 150*a*, 150*c*, respectively, of male connectors 100*a*, 100*c* to provide a positive stop against further insertion and to stabilize the printed circuit board 52 against rocking.

Figure 22:
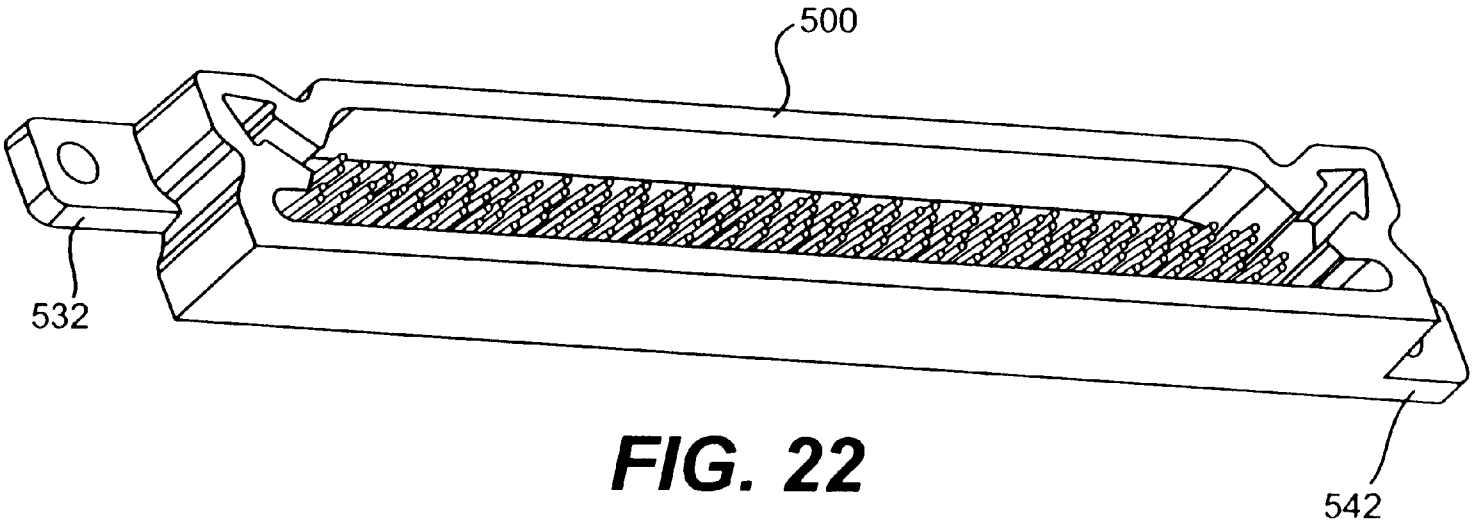
FIGS. 22 and 23 shows an alterative embodiment of a female connector adapted for vertical mounting on the surface of a printed circuit board.
Figure 23:
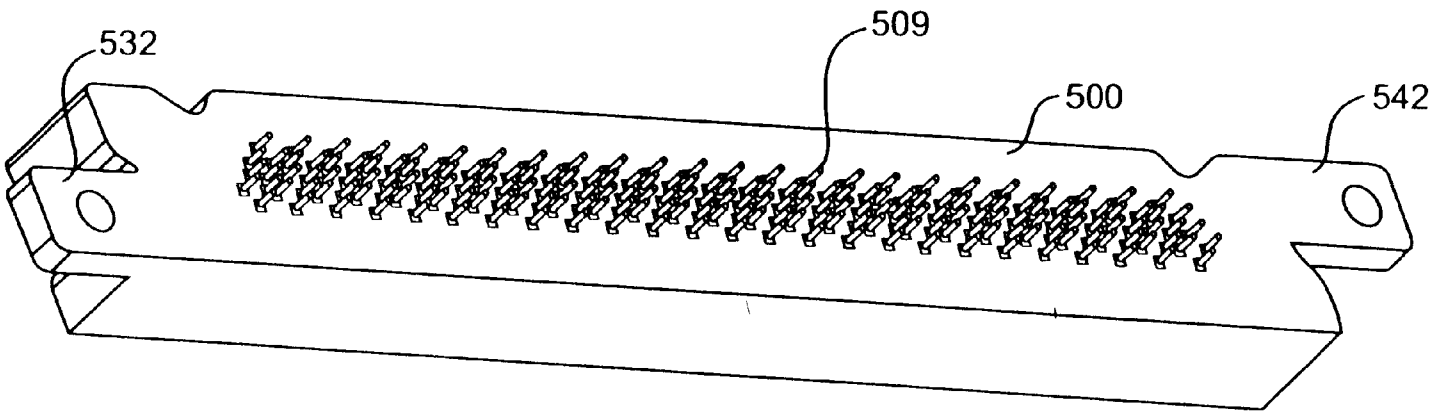
Figure 24B:
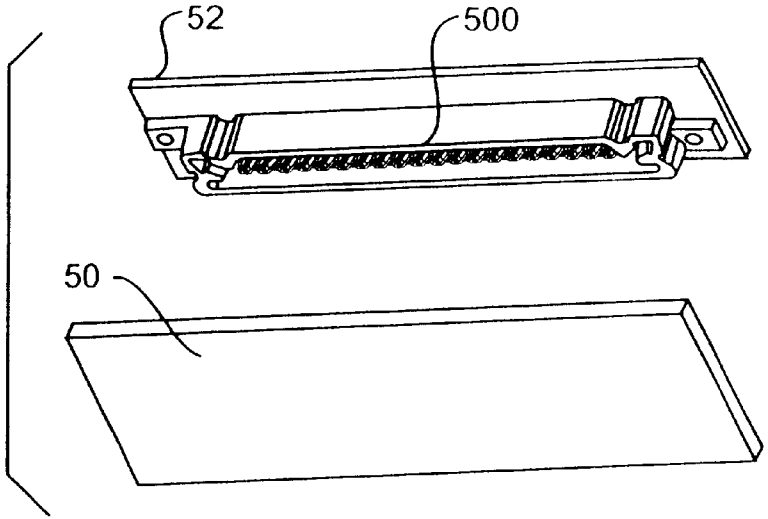
FIGS. 24A, 24B, and 25 illustrate a vertical male connector for connecting to a vertical female connector.
Figure 24A:
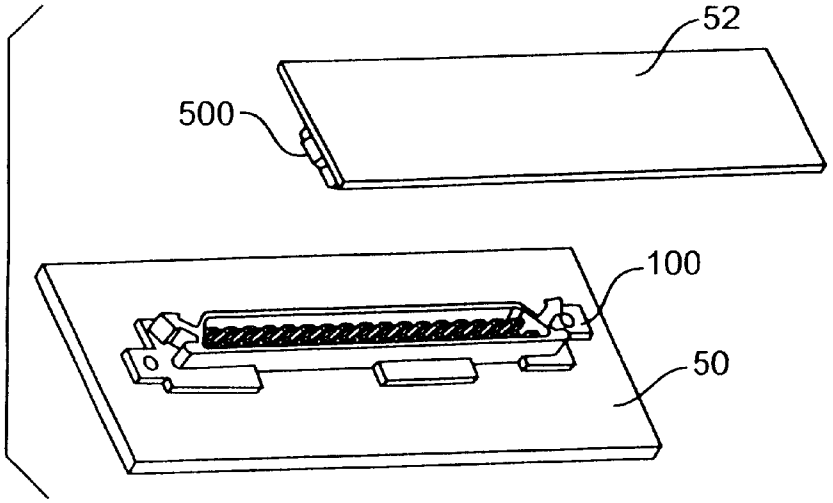
Figure 25:
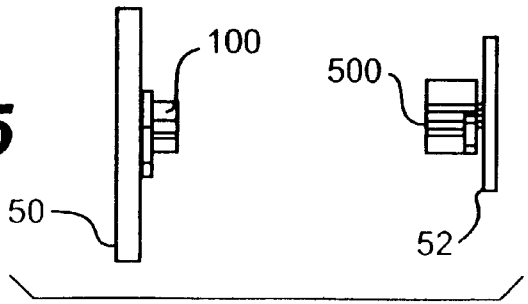

FIGS. 22 and 23 show an alternative embodiment of female connector 500 adapted for vertical mounting on the surface of a printed circuit board. FIG. 23, for example, illustrates that the tail 509 of female pins 505 do not include an elbow section or a vertically-extending section. In this respect, the tail 509 of the female pins 505 is similar to the tail 109 of the male pins 105. As shown in FIG. 23, for example, hold-down tabs 532, 542 are rotated 90° from the position shown in the edge-mounted embodiment. The stand-offs and guide sleeves are omitted for simplicity. FIGS. 24A, 24B, and 25 illustrate a vertical mounted male connector 100 for connection to a vertical mounted female connector 500.

Of course, the hold-down tabs 132, 142 and male pins 105 of male connector 100 may be modified to permit edge mounting similar to, for example, the female connector and female pins discussed above. Further, the vertical-mounted female connector housing 500 may include a stop plate 150 and/or side edge portion 130-1, as described above in connection with the vertical-mounted male connector housing 100. Such stop plate 150 and/or side edge portion 130-1 may be used to support connection of the edge-mounted male connector housing.

Figure 26:
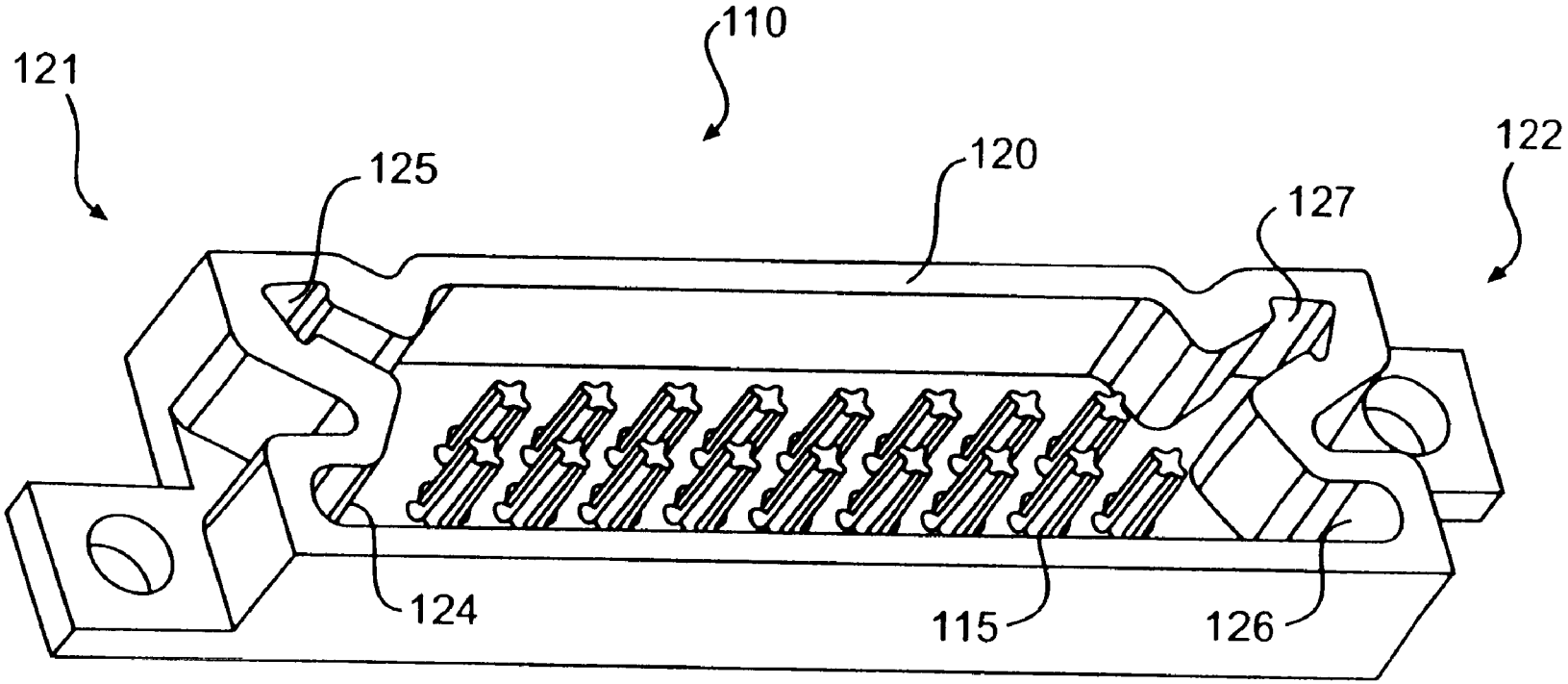
FIG. 26 illustrates a further embodiment of the male connector housing.

FIG. 26 illustrates a further embodiment of the male connector housing 110 in accordance with the present invention. The male connector housing 110 shown in FIG. 26 is generally similar to the male connector housing shown in FIGS. 4–8. For example, it may include stand-offs and/or guide posts. However, the male connector housing 110 includes a side wall 120 similar to the side wall 520 shown above in connection with FIGS. 10–14. In particular, an end 121 of side wall 120 defines a rounded space or void 124 and an arrow-shaped space of void 125, and end 122 of side wall 120 defines a rounded space or void 126 and an arrow-shaped space or void 127. Of course, as described above, the polarization/keying features may point in other directions and/or embody some other asymmetrical arrangement to ensure that mating between the male connector 100 and the female connector 500 occurs in only one orientation. In addition, the side wall 120 may comprise metallic shielding embedded in a polymeric material.

Figure 27A:
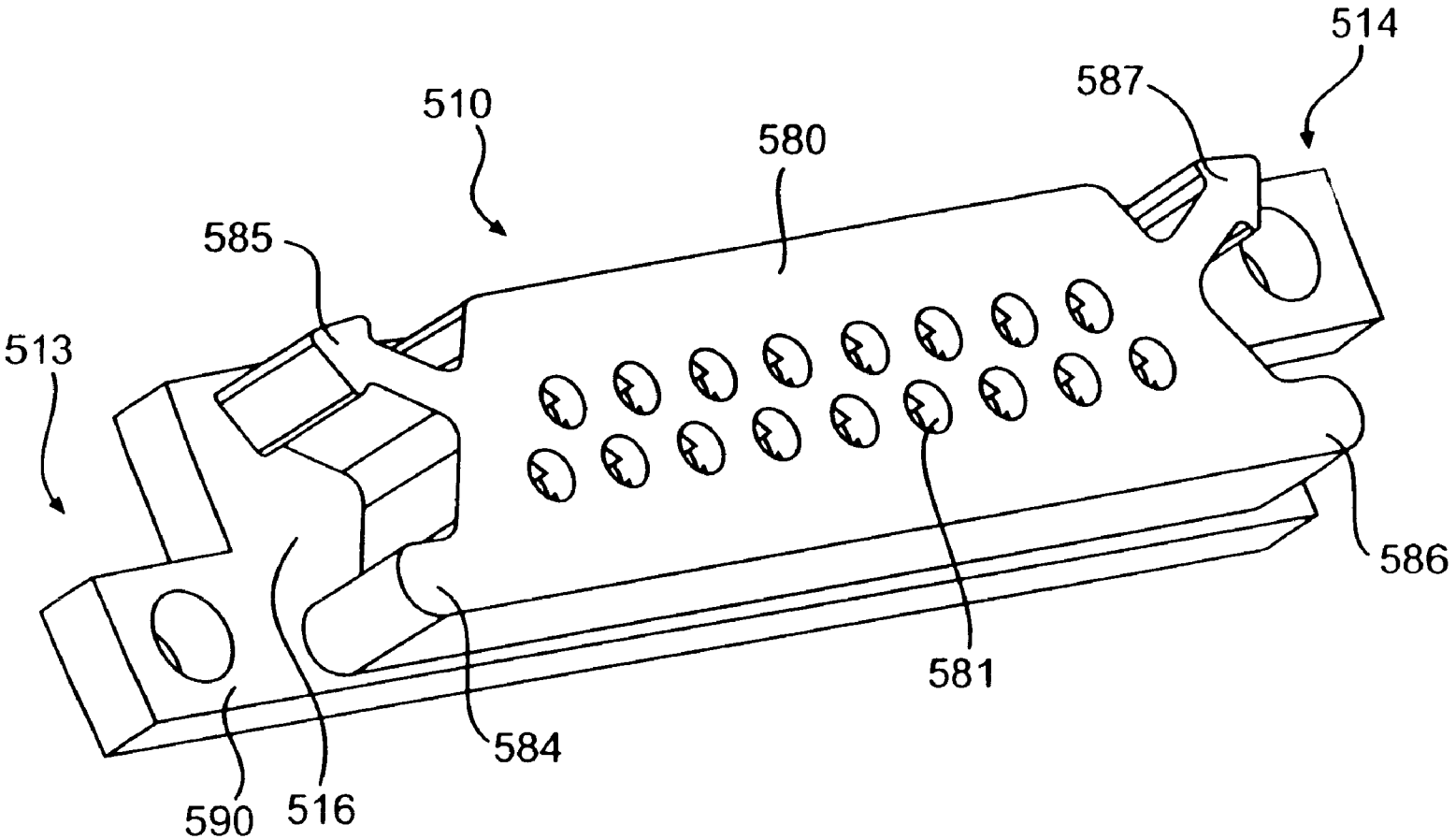
FIGS. 27A and 27B illustrate a further embodiment of the female connector housing having a detachable polarization cap.
Figure 27B:
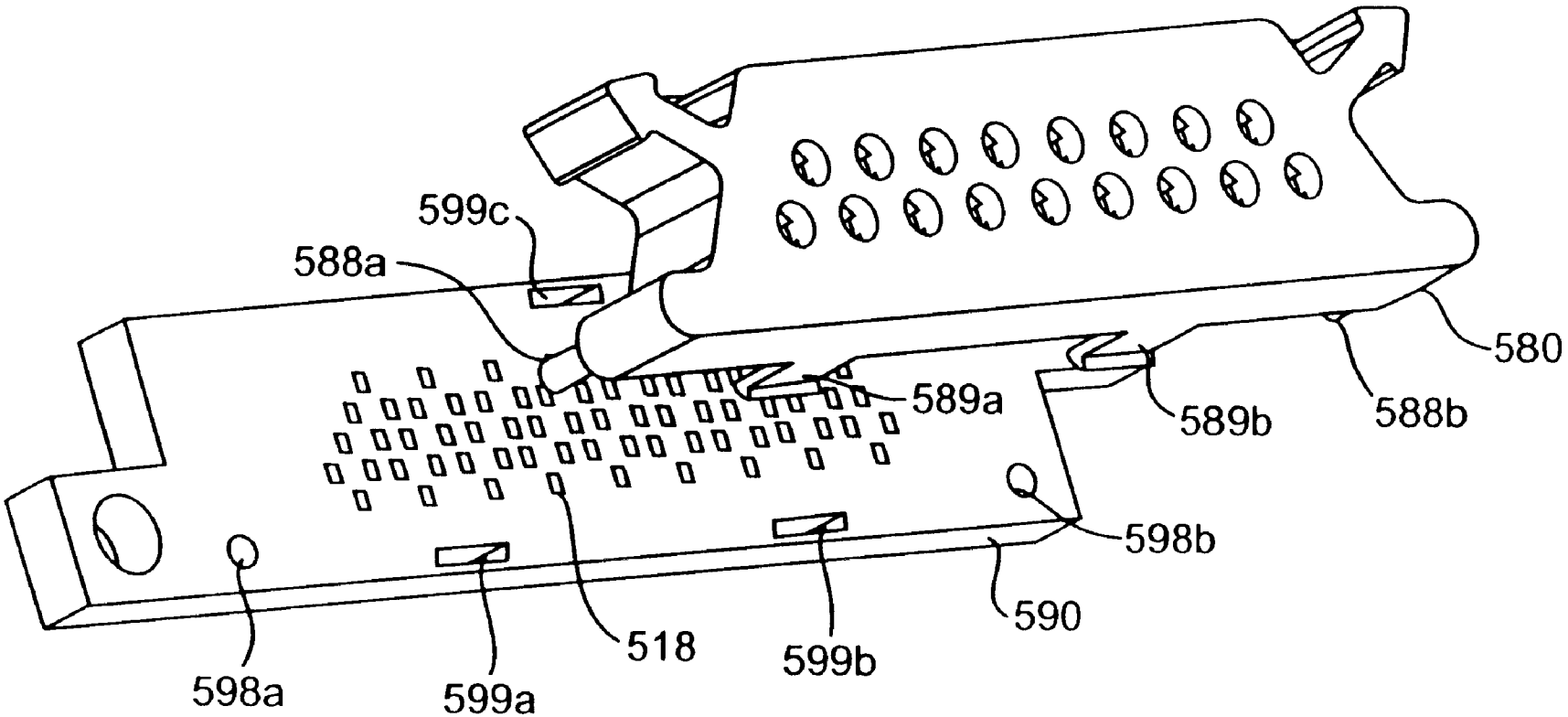
Figure 27C:
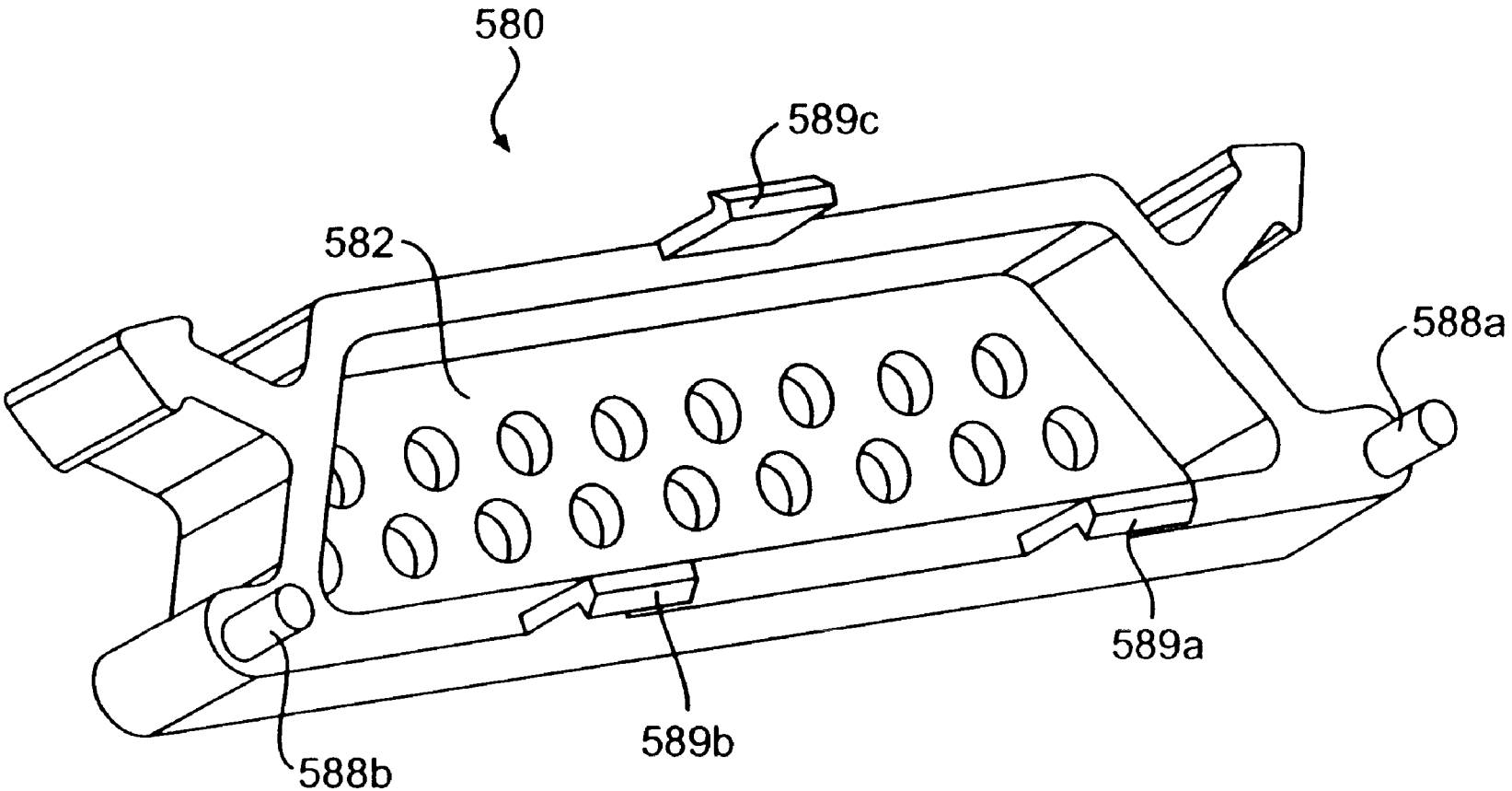
FIG. 27C illustrates the back of the detachable polarization cap.

FIGS. 27A, 27B, and 27C illustrate a further embodiment of the female connector housing 510 having a mounting plate 590 and a detachable polarization cap 580 formed on a top face 516 of the mounting plate 590. The polarization cap 580 includes apertures 581 for receiving male buttresses 115. As shown in best in FIG. 27C, the polarization cap 580 may include a hollow 582 in which the female pins 505 are located. The polarization cap 580 includes a rounded projection 584 and an arrow-shaped projection 585 at one end 513 and a rounded projection 586 and an arrow-shaped projection 587 at an opposite end 514. Of course, a variety of other polarization features and arrangements may be provided in place of or in addition to the polarization features shown in FIGS. 27A and 27B, as discussed above.

The height of the polarization cap 580 may be selected to provide a positive stop between the male connector housing 110 and the female connector housing 510. Alternatively, one or more stop plates may be provided in the manner described above in connection with FIGS. 3-8. The polarization cap may be formed of a polymeric material, e.g., the same material as the female connector housing, and may include metallic shielding embedded therein. The polarization cap 580 or portions thereof may be formed entirely of metal.

FIG. 27B shows that mounting plate 590 includes holes 518 for retaining female contact pins 505. Mounting plate 590 may also include guide holes 598*a*, 598*b* and receiving slots 599*a*, 599*b*, and 599*c*. The guide holes 598*a*, 598*b* are adapted to receive guide posts 588*a*, 588*b*, respectively, of the polarization cap 580. Receiving slots 599*a*, 599*b*, and 599*c* receive clips 589*a*, 589*b*, and 589*c*, respectively, for retaining the polarization cap 580 to the mounting plate 590. The guide holes and guides posts are optional, and other means, such as screws, rivets, adhesives, and/or other snap-on connectors, may be used to retain the polarization cap 580 to the mounting plate 590.

Figure 28A:
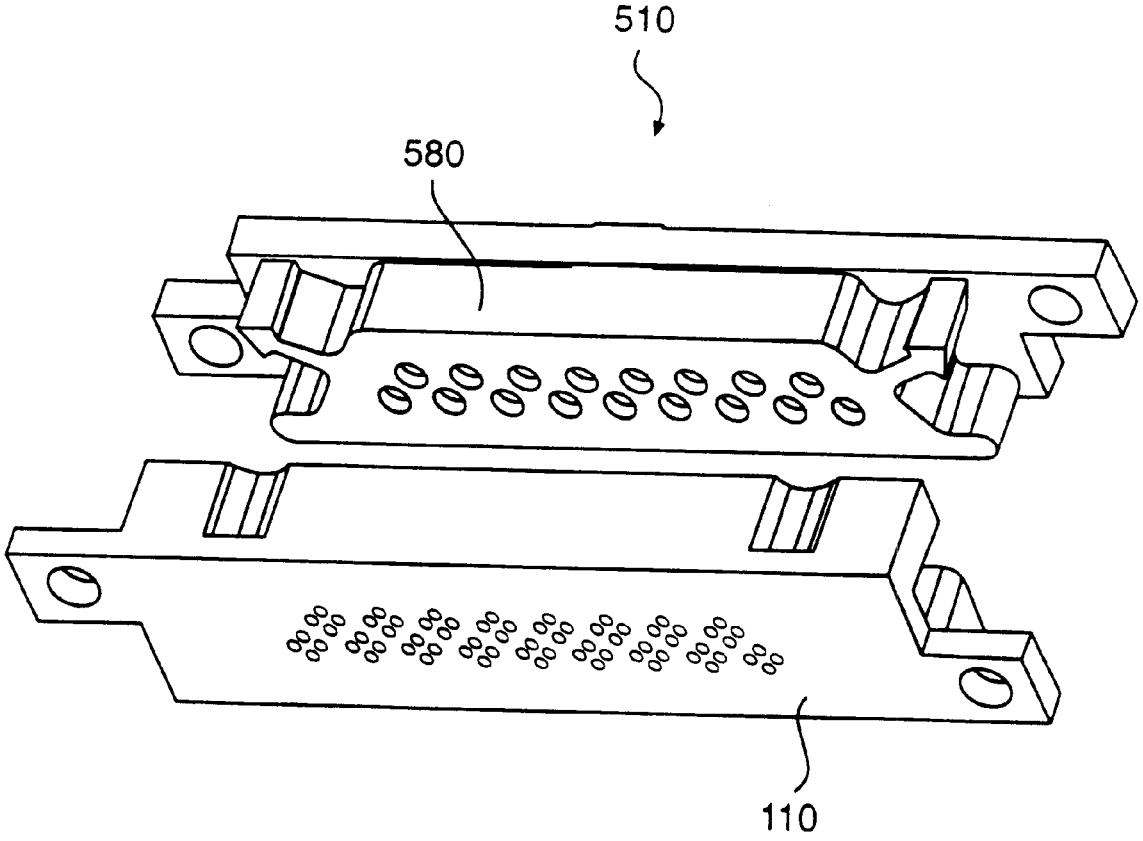
FIG. 28A illustrates the mating connection between the male connector housing shown in FIG. 26 and the female connector housing having the detachable polarization cap shown in FIG. 27C.

FIG. 28A illustrates the mating connection between the male connector housing 110 shown in FIG. 26 and the female connector housing 510 having the detachable polarization cap 580 shown in FIG. 27C. Side wall 120 of the male connector housing 110, including rounded spaces 124, 126 and arrow-shaped spaces 125, 127, receive the polarization cap 580 of the female connector housing 510, including its rounded projections 584, 586 and its arrow-shaped projections 585, 587. The combination of these features serves to guide the male and female connectors into proper alignment for mating and to prevent mating at an improper angle, at an offset, or both.

Figure 28B:
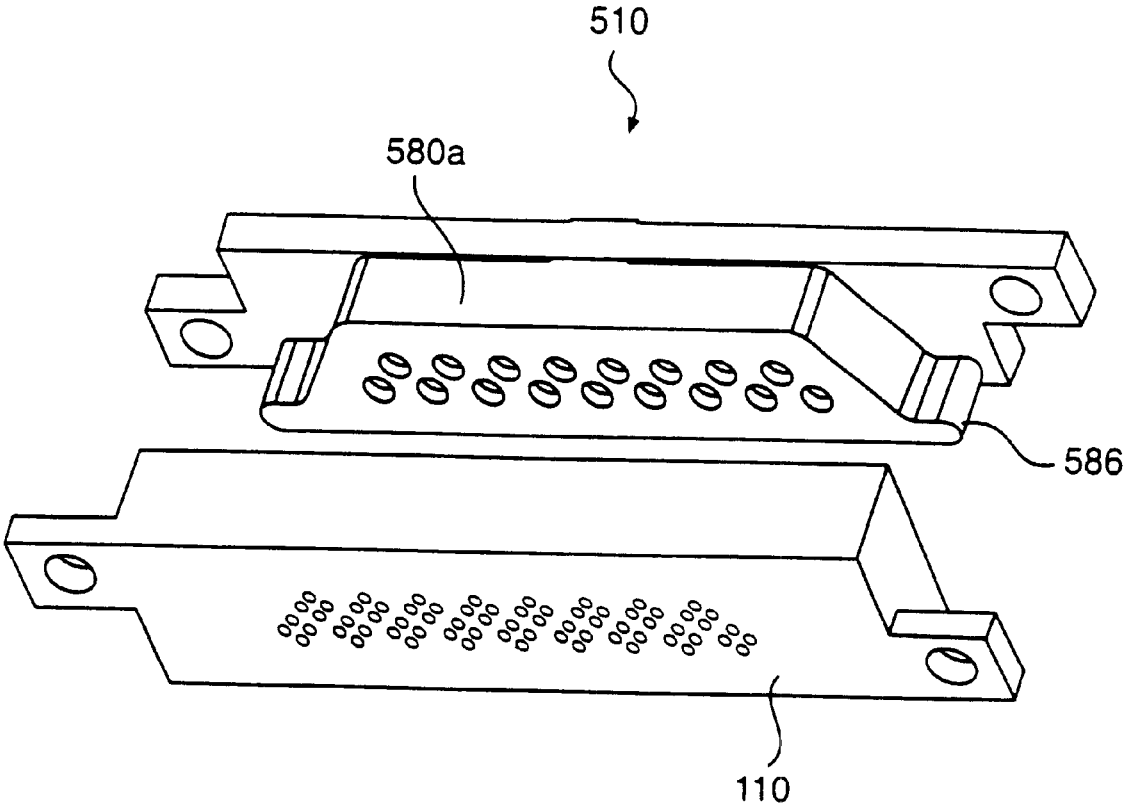
FIG. 28B illustrates the mating connection between the male connector housing shown in FIG. 26 and a further embodiment of a female connector housing having a detachable polarization cap.

FIG. 28B illustrates the mating connection between the male connector housing 110 shown in FIG. 26 and a further embodiment of a female connector housing 510 having a detachable polarization cap 580*a*. In this case, the polarization cap 580*a* includes only rounded projections 584, 586. FIG. 28B illustrates two important concepts. First, FIG. 28B illustrates that different polarization caps may be interchangeable on the mounting plate depending, for example, on the use made of the connector. Second, polarization cap 580*a* shown in FIG. 28B may be mated with a male connector housing 110 having a side wall 120 defining both rounded spaces 124, 126 and arrow-shaped spaces 125, 127, as shown in FIG. 26. Alternatively, the polarization cap 580*a* may be mated with a male connector defining only rounded spaces 124, 126. The polarization cap 580 shown in FIG. 28A, for example, may only be mated with a male connector housing 110 having a side wall 120 with both rounded spaces and arrow-shaped spaces, as shown in FIG. 26. Thus, by defining different polarization arrangements and various subsets thereof, hierarchies of matable connector combinations may be defined. For example, the various subsets may defined different functional attributes. Of course, the polarization features of the polarization cap 580*a* illustrated in FIG. 28B may be made unique such that the polarization cap 580*a* may be coupled only to a single polarization type of female connector housing.

It will be apparent to those skilled in the art that various modifications and variations can be made in the male and female connectors of the present invention without departing from the scope or spirit of the invention. For example, the male and female connector housings 110, 510 may include power and/or ground connectors as an alternative or in addition to the polarization features. In this regard, hierarchies of matable connectors may be defined such that a 5 V power connection is established through one polarization feature (e.g., an arrow-shaped void at a first end of the connector housing) and a 3.3 V power connection is established though another polarization feature (e.g., an arrow-shaped void at a second end of the connector housing). Accordingly, the connector housing would support applications having 5 V power requirements, 3.3 V power requirements, and both 5 V and 3.3 V power requirements. Moreover, the side wall 120, including the polarization features, of the male connector housing 110 shown in FIG. 3-8 and in FIG. 26 may be detachable in the same manner as described above in connection with the polarization cap 580 of the female connector housing 510.

Figure 29A:
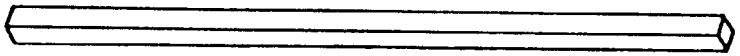
FIGS. 29A–29F illustrate the manufacture of female pins 505.
Figure 29B:
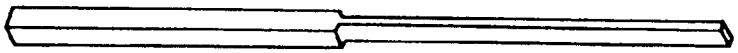
Figure 29C:
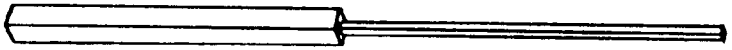
Figure 29D:
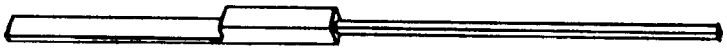
Figure 29E:
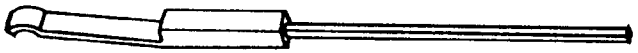
Figure 29F:
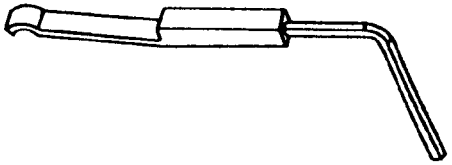

FIGS. 29A-29F illustrate one method of manufacturing the female pins 505. As shown in FIG. 29A, the manufacturing process begins with a section of wire 800. The section of wire may be a separate length of wire or may form part of a longer, continuous length of wire along which female pins are formed at intervals. The wire 800 may have a square cross section with sides of 0.022 inches (0.5588 mm). Of course, the manufacturing may be accomplished using wire of a different thickness and/or cross section. FIG. 29B shows that the wire 800 is cut to form, for example, a first side 509-1*a* and the second side 509-1*b* of the tail 509. The wire may be cut using a standard cutting tool known in the art. FIG. 29C shows that the wire 800 is cut again in a direction perpendicular to the first cut to form the third side 509-1*c* and the fourth side 509-1*d* of the tail 509. Next, wire 800 is cut a third time to form an intermediate stage 506*a* of the contact portion 506, as shown in FIG. 29D. FIG. 29E shows that the tip 506-1 and the flexible beam 506-2 are formed. The tip 506-1 and the flexible beam 506-2 may be formed by a die, an anvil, or another forming tool. Finally, the tail 509 is bent and cut to length to form the completed female pin 505, as shown in FIG. 29F. The direction of the bend relative to the contact portion, the location of the bend, and the length of the tail portion determine the position of the female pin in the female connector housing. Of course, a male pin adapter for edge mounting may be manufactured in the same way as described above. The contact pins may be plated either before or after bending.

As should be apparent from the above description, the female pin is formed without stamping. Further, the axis of the female pin corresponds to the axis of the wire from which the female pin is formed. Accordingly, the female pin will retain its flexibility and resiliency.

Figure 30:
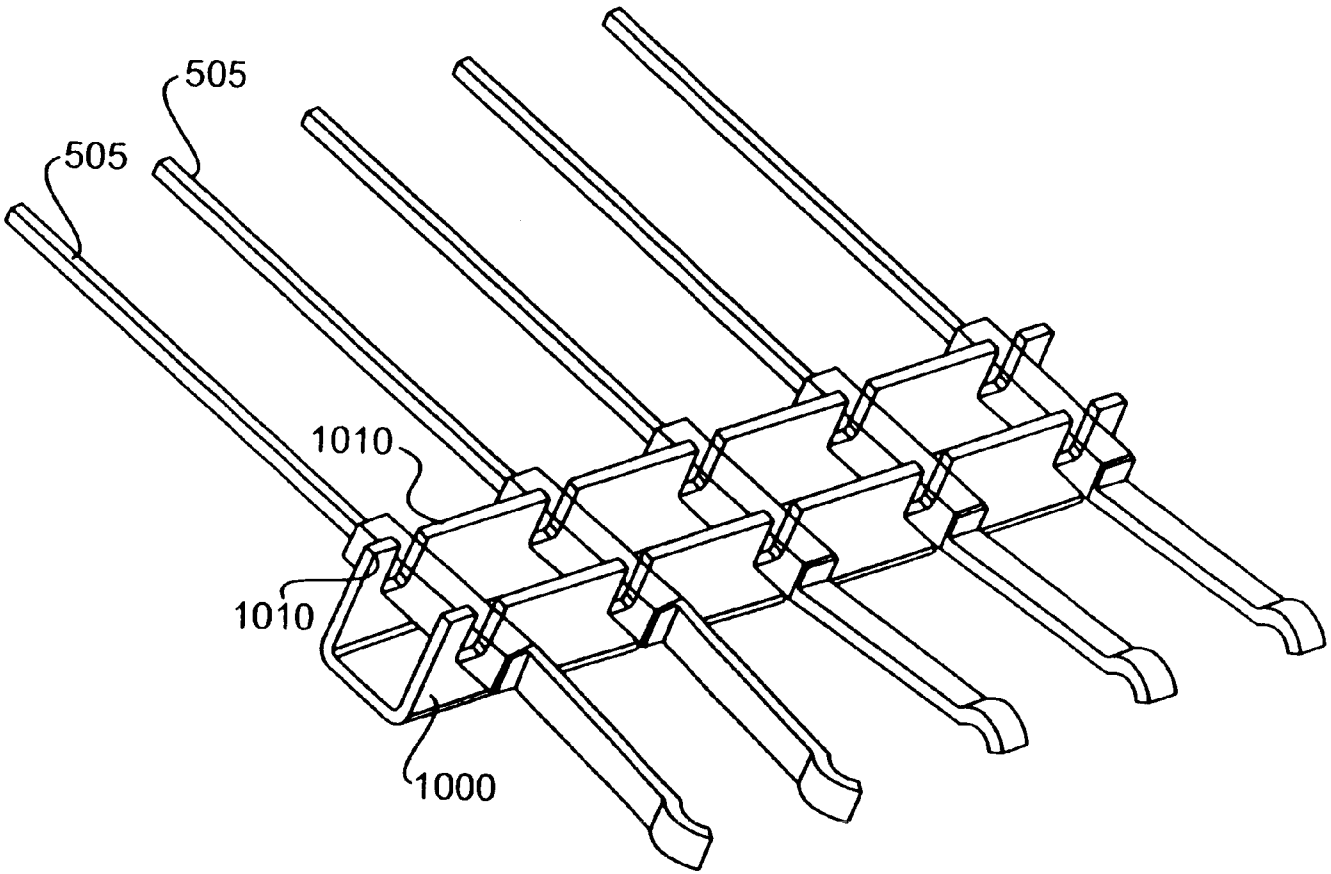
FIG. 30 shows a plurality of female contact pins mounted in a bandolier.

After forming the female and male contact pins, the contact pins may be mounted to a bandolier. FIG. 30 shows female contact pins 505 mounted to a bandolier 1000. The bandolier 1000 is formed by a metal strip, such as brass, that is cut and bent to form grips 1010 on its sides. The contact pins 505 are held in the grips 1010. The bandolier 1000 is then fed to an automated pin insertion machine. As shown in FIG. 30 and as discussed above, the contact pins may be held in the grips 1010 in several orientations to facilitate insertion into the connector housing. The bandolier further facilitates plating of the contact pins. Consequently, the contact pins need not be rotated by the automated pin insertion machine prior to insertion.

Figure 31:
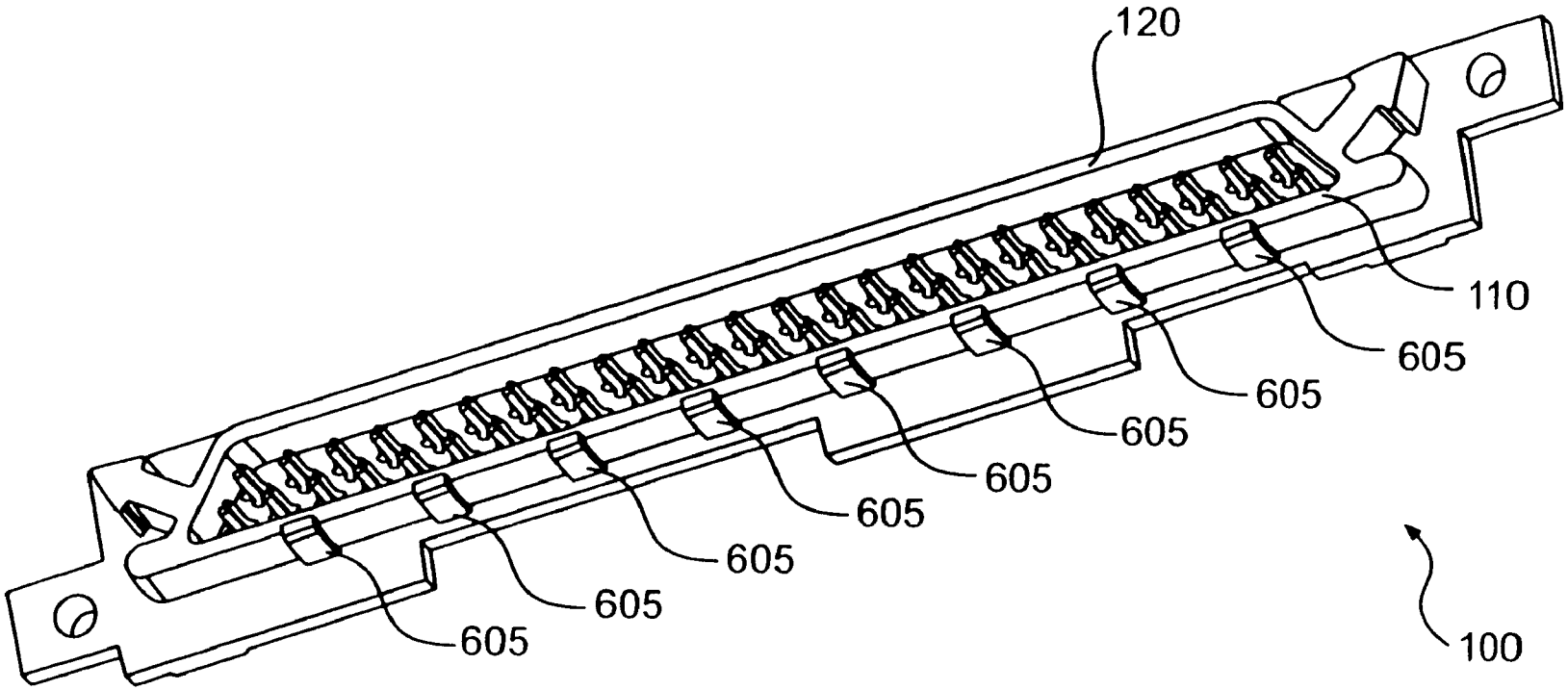
FIG. 31 illustrates an alternative embodiment of a male connector including power and/or ground leads.

FIG. 31 illustrates a further embodiment of a male connector 100 that includes a plurality of power/ground leads 605 held in the male connector housing 110. As shown, the leads 605 are arranged on an exterior side surface of the side wall 120. The leads 605 may extend through the back of the male connector housing 110 for connection to a printed circuit board or other substrate. In this regard, individual ones of the leads 605 may be connected via surface mounting or through holes to a ground line or a power supply line on a printed circuit board or other substrate. Some of the leads 605 may be connected to ground lines and others to power lines or, alternatively, all of the leads may be connected to ground lines or to power lines. The leads 605 may be larger that the male contact pins 105, as shown, to support a larger current carrying capacity.

Figure 32:
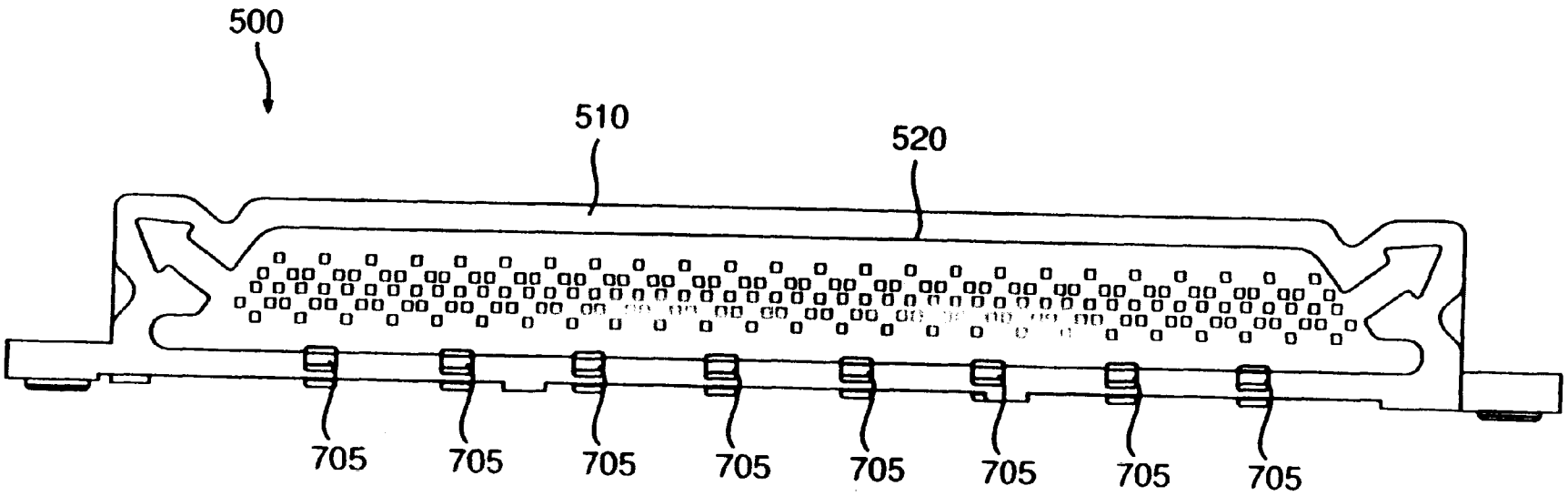
FIG. 32 shows an alternative embodiment of a female connector including power and/or ground leads.

FIG. 32 illustrates a further embodiment of a female connector 500 including a plurality of power/ground leads 705 held in the female connector housing 510. The leads 705 are arranged on an interior side surface of the side wall 520 to facilitate mating with corresponding power/ground leads 605 held in the male connector housing 110. The leads 705 may extend through the back or bottom of the female connector housing 510 to enable connection to a printed circuit board or other substrate. Similar to the power/ground leads 605, individual ones of the leads 705 may be connected via surface mounting or through holes to a ground line or a power supply line on a printed circuit board or other substrate. The leads 705 may be larger than the female contact pins 505, as shown, to support a larger current carrying capacity. Distributing power and/or ground line connections along the length of the male and female connector housings 110, 510 results in improved power/ground distribution and redundancy in mating contacts.

Figure 33:
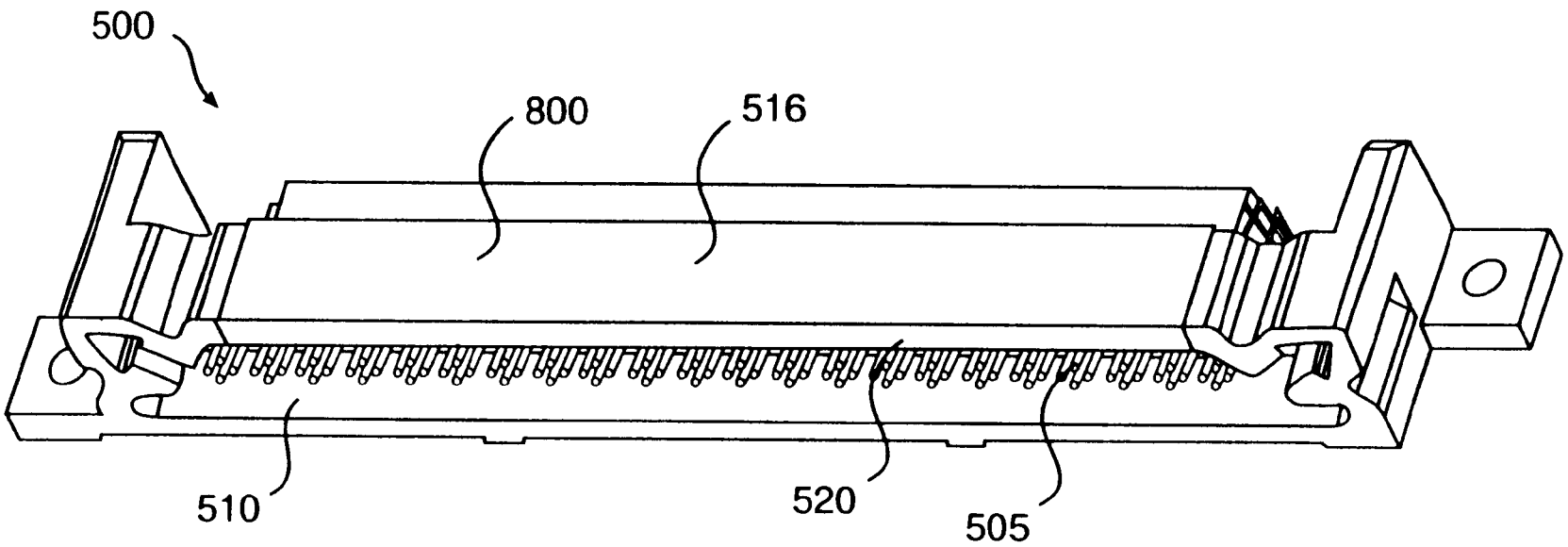
FIGS. 33, 34, and 35 illustrate an embodiment of the female electrical connector having shielding for shielding against noise or other interference.
Figure 34:
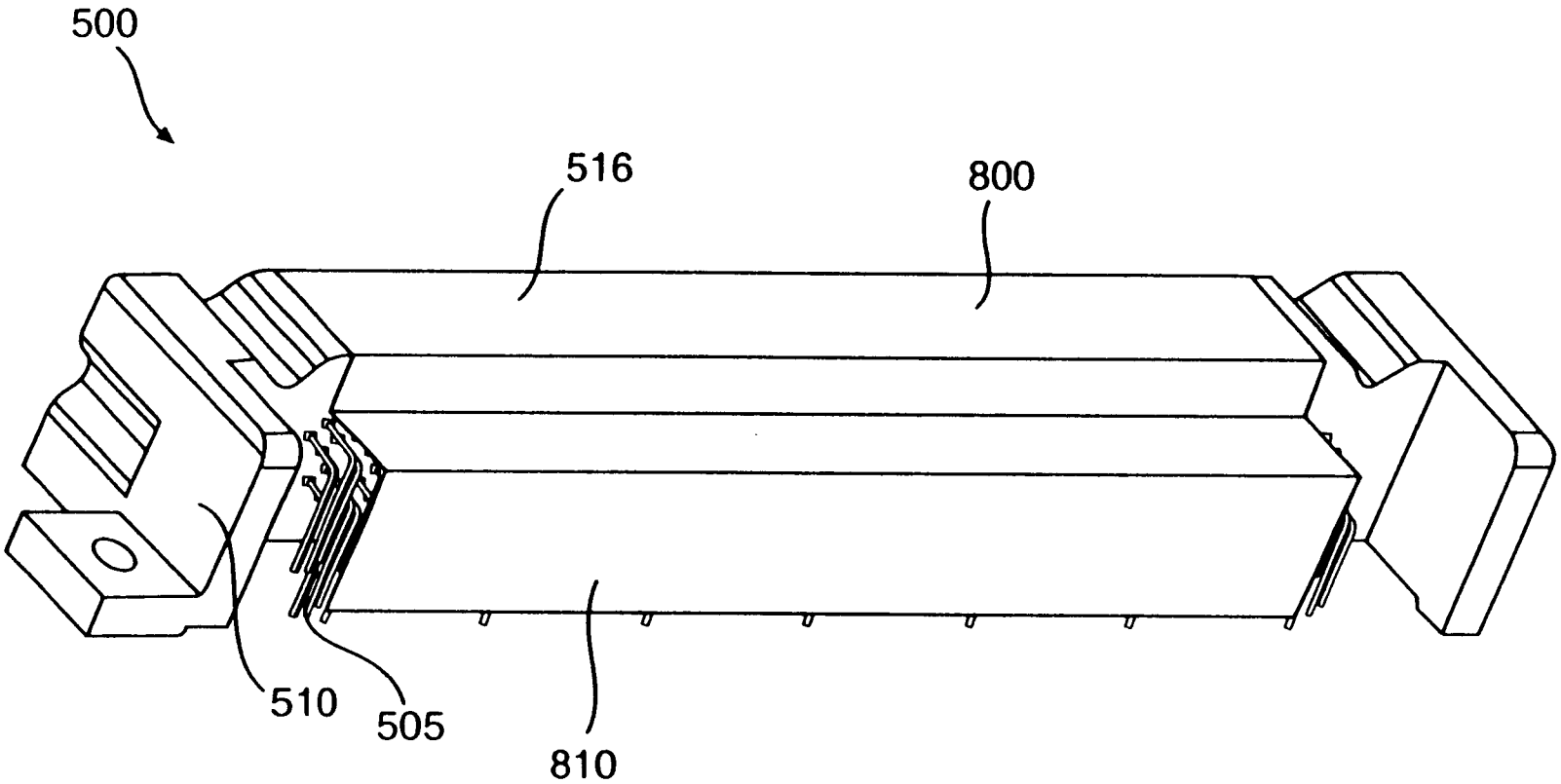
Figure 35:
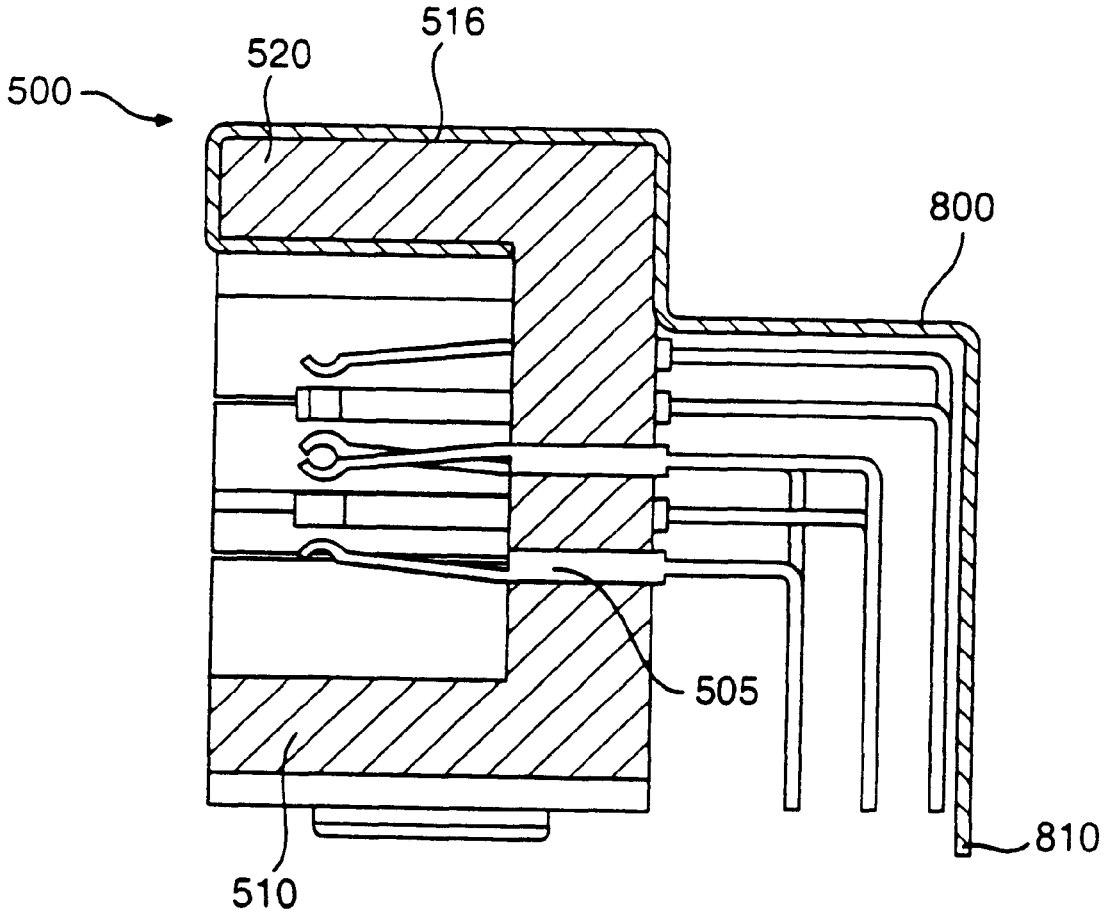

FIGS. 33, 34, and 35 illustrate an embodiment of the female electrical connector 500 having shielding 800 for shielding against noise or other interference that may be imposed on the electrical signals carried by the female contact pins 505. As shown, metallic shielding 800 covers an interior and exterior surface of the side wall 520, extends over the top 516 of the connector housing 510, and covers the tail portions of the female contact pins 505. The end 810 of the shielding 800 may be electrically connected to the surface of the printed circuit board or other substrate. Of course, the shielding 800 may be provided to continuously surround the female contact pins 505 to provide an added measure of shielding.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A female contact pin for use in an electrical connector, comprising:

a stabilizer portion configured for securement to a female connector housing, the stabilizer portion having a longitudinal axis and a first width transverse to the longitudinal axis, the stabilizer portion having an outer periphery defining a volume; and a flexible contact portion for contacting a male contact, wherein when the flexible contact portion is unflexed, the flexible contact portion extends at an angle from the stabilizer portion to traverse a lateral distance in a direction of the first width, wherein the lateral distance spanned by the entirety of the flexible contact portion in a direction of the first width is substantially the same as or less than the first width, the flexible portion is disposed within a projection of the volume of the outer periphery of the stabilizer portion.

2. A female contact pin according to claim 1, wherein said flexible contact portion is adapted to be flexed so that said contact portion and said stabilizer portion are aligned.

3. A female contact pin according to claim 1, wherein said flexible contact portion is substantially straight.

4. A female contact pin according to claim 1, further comprising a flexible tail extending from said stabilizer portion opposite said contact portion.

5. A female contact pin according to claim 4, wherein said flexible tail includes a horizontally-extending portion extending from said stabilizer portion and a vertically-extending portion, wherein said horizontally-extending portion pivots with respect to said stabilizer portion.

* * * * *